United States Patent [19]

Horvath

[11] 4,345,718

[45] Aug. 24, 1982

[54] MANUALLY ACTUATED TRIGGER SPRAYER

[76] Inventor: William Horvath, 10 Crestwood Dr., Watchung, N.J. 07060

[21] Appl. No.: 106,398

[22] Filed: Dec. 26, 1979

Related U.S. Application Data

[63] Continuation-in-part of Ser. No. 32,334, Apr. 23, 1979, abandoned, which is a continuation-in-part of Ser. No. 875,685, Feb. 6, 1978, abandoned.

[51] Int. Cl.[3] ..... B05B 9/043

[52] U.S. Cl. ..... 239/333; 222/182; 222/207; 222/340

[58] Field of Search ..... 239/329, 331, 333, 321; 222/182, 207, 214, 340, 378, 383, 482, 494; 417/550, 552, 553

[56] References Cited

U.S. PATENT DOCUMENTS

| | | | |
|---|---|---|---|
| 3,053,459 | 9/1962 | Corsette | 239/337 |
| 3,135,220 | 6/1964 | Haynes . | |
| 3,249,259 | 5/1966 | Corsette | 222/182 |
| 3,282,472 | 11/1966 | Roder | 222/321 |
| 3,391,647 | 7/1968 | Corsette et al. . | |
| 3,469,744 | 9/1969 | Corsette | 222/635 |
| 3,493,170 | 2/1970 | Tomiyama | 251/58 |
| 3,591,088 | 7/1971 | Green | 239/304 |
| 3,596,808 | 8/1971 | Corsette | 222/321 |
| 3,672,545 | 6/1972 | Marand | 222/635 |
| 3,685,739 | 8/1972 | Vanier | 239/333 |
| 3,701,478 | 10/1972 | Tada | 239/333 |
| 3,756,512 | 9/1973 | Dyal | 239/337 |
| 3,762,647 | 10/1973 | Tada | 239/321 |
| 3,785,571 | 1/1974 | Hoening | 239/492 |
| 3,788,550 | 1/1974 | Nishiguchi et al. | 239/337 |
| 3,797,749 | 3/1974 | Tada | 239/333 |
| 3,823,847 | 7/1974 | Ware | 222/383 |
| 3,874,562 | 4/1975 | Hazard | 222/211 |
| 3,913,841 | 10/1975 | Tada | 239/321 |
| 3,927,834 | 12/1975 | Tada | 222/383 |
| 3,938,711 | 2/1976 | Ewald et al. | 222/209 |
| 3,949,910 | 4/1976 | Focht | 222/321 |
| 3,958,727 | 5/1976 | Steiman | 222/402.24 |
| 3,963,150 | 6/1976 | Steiman et al. | 222/211 |
| 3,973,700 | 8/1976 | Schmidt et al. | 222/207 |
| 3,995,774 | 12/1976 | Cooprider et al. | 222/383 |
| 4,033,487 | 7/1977 | Micallef | 222/207 |
| 4,057,176 | 11/1977 | Horvath | 239/333 |
| 4,061,254 | 12/1977 | Nilson | 222/494 |
| 4,109,869 | 8/1978 | Brockelsby et al. | 239/333 |
| 4,113,147 | 9/1978 | Frazier et al. | 222/383 |
| 4,146,155 | 3/1979 | Kutik et al. | 239/331 |
| 4,155,487 | 5/1979 | Blake | 222/383 |
| 4,241,853 | 12/1980 | Pauls et al. | 222/383 |
| 4,249,681 | 2/1981 | French | 222/494 |

FOREIGN PATENT DOCUMENTS

| | | | |
|---|---|---|---|
| 674665 | 12/1965 | Belgium | 239/333 |
| 2744654 | 4/1978 | Fed. Rep. of Germany | 239/333 |
| 2901038 | 8/1979 | Fed. Rep. of Germany | 239/333 |
| 58944 | 11/1967 | German Democratic Rep. | 239/333 |
| 1102612 | 2/1968 | United Kingdom | 239/333 |

*Primary Examiner*—Robert B. Reeves
*Assistant Examiner*—Michael J. Forman
*Attorney, Agent, or Firm*—Martha G. Pugh

[57] ABSTRACT

Sprayer for fluid product in which a hand-actuated trigger forces a hollow piston mounted to move in vertical reciprocating fashion in a stationary tubular accumulator, against the compression of a spring. The product is forced upward and out through a swirl chamber adjacent the spray nozzle. Additional product is siphoned up into the accumulator by the partial vacuum created by the return of the piston to its rest position. Alternative embodiments, including both a vertically and horizontally directed sprayer, feature an annular flexible flange seating against an annular skirt below a swirl chamber, which keeps air out of the product chamber and deflects inwardly to release product under pressure. Additionally, a horizontally-directed spray-head may be attached to the vertical trigger sprayer for the purpose of converting the latter to a horizontal sprayer. Further embodiments comprise modification of the annular flexible flange including separate flange-type components which may be force-fitted into the accumulator top, and are constructed to tangentially seal against the annular skirt and deflect to release product. A dome and stopper structure may be used to replace the annular flexible flange, which acts as a diaphragm flexing under pressure to release product. Due to the flexible flange which deflects to allow the product to enter the swirl chamber, the sprayer may be used in an inverted position, provided a centrally-disposed siphon tube is removed.

27 Claims, 35 Drawing Figures

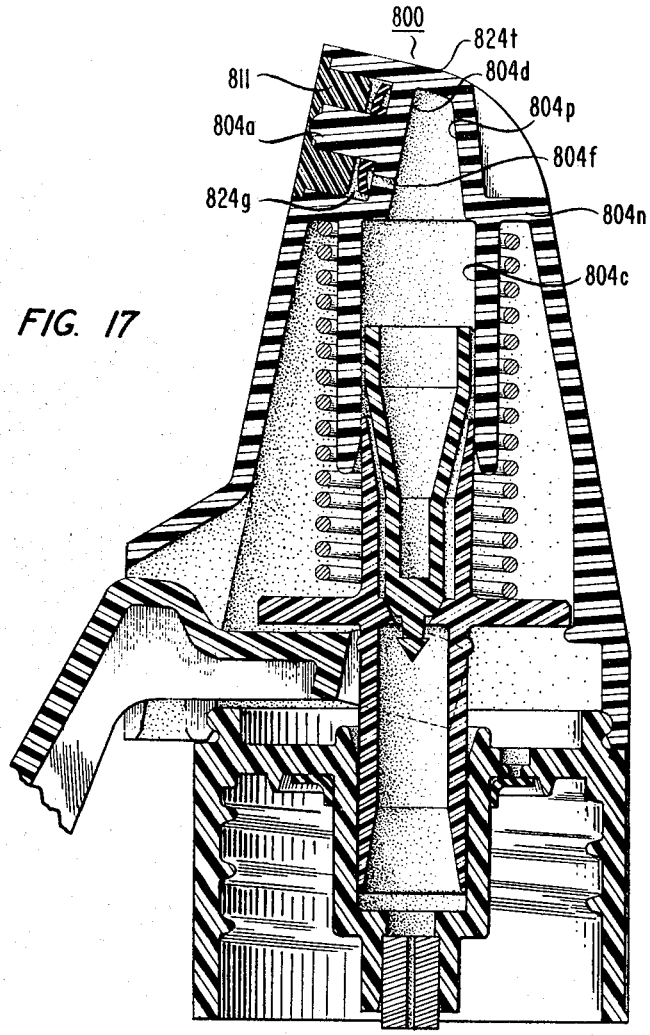
FIG. 17
FIG. 18
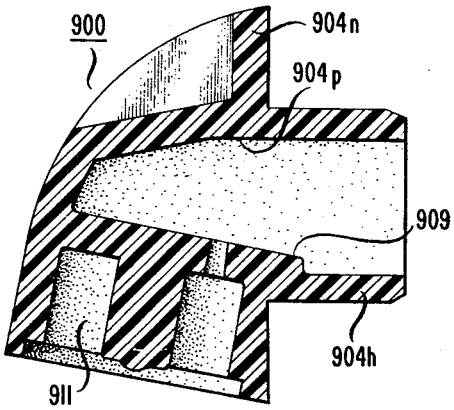
FIG. 16
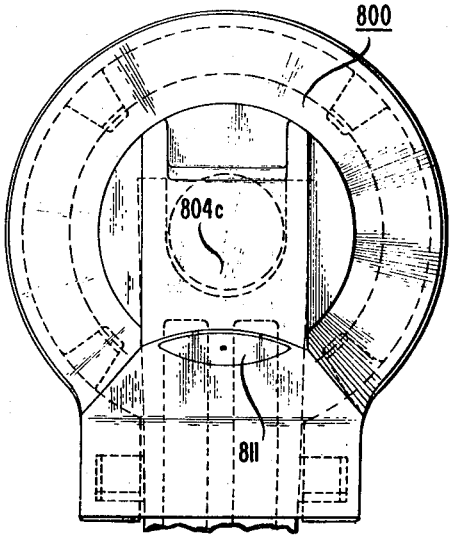

MANUALLY ACTUATED TRIGGER SPRAYER

This is a continuation-in-part of my U.S. patent application, Ser. No. 32,334, filed on Apr. 23, 1979, now abandoned, which is a continuation-in-part of my U.S. patent application, Ser. No. 875,685, filed on Feb. 6, 1978 now abandoned.

BACKGROUND OF THE INVENTION

This relates in general to hand-operated spray dispensers, and more particularly to trigger-operated spray dispensers of fluid products.

Aerosol spray dispensers, heretofore widely used, particularly those types employing fluorocarbons, are now being replaced because scientific studies have shown that they may produce harmful environmental effects; and further, the fluorocarbon carriers may be increasingly difficult or expensive to obtain. It is necessary that dependable replacements be found which can be actuated without the application of excessive pressure by the user to produce a spray of uniformly high pressure, without throttling or dripping from the nozzle between or during spray applications. It is further desirable that a spray dispenser be provided in which the stored product, and the mechanism itself, is protected from atmospheric deterioration. Further, the mechanism should be simple and inexpensive to fabricate, and should be adapted for the use of many different types of products.

SUMMARY OF THE INVENTION

It is, therefore, a principal object of this invention to provide an improved spray dispenser, more particularly of a trigger-operated type which can be hand actuated without the application of excessive force by the user. Another object of the invention is to provide a trigger-actuated sprayer which produces a directed spray having a uniformly high pressure in response to actuation by the user, and which is not susceptible to throttling or dripping from the nozzle when the pressure is reduced. Another object of the invention is to provide a spray dispenser in which the stored product is protected from deterioration due to contact with the atmosphere; and in which the mechanism itelf does not become clogged with oxidized product, or its metal parts corroded. A further object of the invention is to provide a spray dispenser which can be adapted or modified for use with many different types of products, and which can be readily modified for different customer requirements. It is a further object of the invention to provide a spray dispenser especially designed for viscous products, or any products which are best emitted in a dry spray. It is a further object of the invention to provide a spray dispenser which has a relatively small number of moving parts, and which is simple and inexpensive to fabricate. A still further object is to provide a spray dispenser which can function right-side-up or in an inverted position.

These and other objects are realized in a spray dispenser in accordance with the present invention, comprising a container of fluid on which is mounted a stationary accumulator housing, having an axially-disposed tubular accumulator and a nozzle from which spray is dispensed by depressing a trigger mechanism. The latter operates a horizontally disposed lever to raise a hollow piston vertically in axial relation to the tubular accumulator against the compression of a helical spring.

This operation forces any product fluid therein out through a swirl chamber surrounding the dispensing nozzle. The hollow piston returns to its rest position, forming a partial vacuum, which releases a coaxially disposed check valve of inverted conical shape centrally mounted in the hollow piston, causing additional fluid product to be sucked up from the container into the accumulator for a succeeding trigger operation.

A first embodiment is constructed to dispense spray vertically through a nozzle surrounded by a swirl chamber disposed in the top of the accumulator. The swirl chamber has an annular downwardly directed skirt, forming an inner chamber in the form of an inverted cup disposed below the swirl chamber. An upwardly-directed annular flange at the upper end of the accumulator bears against the inner surface of the skirt, forming a normally closed valve which is sealed against the intake of air into the system through the nozzle, but which is deflected inwardly in response to the pressure of fluid product forced up through the accumulator by vertical motion of the hollow piston.

A second embodiment which is constructed to dispense spray horizontally, has a nozzle housing at the top of the accumulator which includes an inwardly-directed diaphragm bearing against and sealing an internal opening leading up from the accumulator. The pressure of fluid product against its underside deflects the diaphragm, releasing fluid product into an annular chamber in the nozzle housing leading to a laterally directed swirl chamber, through which the fluid product is forced to direct a stream of spray horizontally.

In addition, a horizontally-directed spray member, constructed for attachment to the vertical trigger sprayer, functions to convert the latter to a horizontal trigger sprayer. A similar modification may also be employed in an integrally-formed horizontal trigger sprayer.

A further modification of the horizontal trigger sprayer is especially designed for high viscosity products, or any products which are best emitted in a dry spray. This includes an annular air-compression chamber which may provide, for example a ratio of between 10 to 30 parts of air to one part of product, thereby creating a fine breakup of viscous product, or a fine dry spray.

Further modifications of both the vertical and horizontal trigger sprayers feature an annular flexible flange which is made of a lower density material, making it more flexible than the flange of the previously described embodiments. This flexible flange is force-fitted into a groove on an internal partition. It is designed to function similarly to previous embodiments, but bends to deflect inwardly under less pressure, allowing for use of a more viscous product. Also, the flange seals to keep air out, thus preventing excess product from crystallizing. This flexible flange performs a similar function to that of the diaphragm in the previous horizontal sprayer.

Further modifications of the flexible flange include a two-piece structure, comprising a dome and a stopper, with an accompanying skirt. The skirt, which may be constructed of low density polyethylene, flexes under pressure, unplugging a central opening allowing the product to enter the mixing chamber. Also, the flexible flange may be replaced by an annular pressure control valve force-fitted around a cylindrical plug on the accumulator top. This valve may also be constructed of low density polyethylene, which deflects upwardly to release the product into the mixing chamber.

In addition to the trigger mechanism and reciprocating hollow piston, a common feature of the disclosed vertical and horizontal spray dispensers is a hinged annular gasket held in place between the mouth of the container and the screw-top, which is disposed to seal against the underside of a small opening in the screw-top. The annular gasket functions to open up and admit air into the fluid storage container when the pressure in the latter is reduced below atmospheric pressure, and to seal the opening when the pressure in the container reaches atmospheric pressure. A modified form of gasket is disclosed, terminating in a vertically-extending rounded flange, the inner end which has the advantage of providing a seal in different positions of the gasket.

A principal advantage of the trigger sprayer of the present invention is that the trigger mechanism is adapted to be manually actuated by the user to produce a substantial multiplication of the force which is applied to lift the hollow piston vertically against the compression of the spring. Moreover, the ratio of force multiplication can readily be controlled by increasing or decreasing the trigger arm and other parameters, in accordance with well-known lever principals to obtain exactly the desired ratio to accord to user requirements.

Another advantage of the systems of the present invention is that due to the cooperating relationship between the central check valve in the movable hollow piston and the product-deflected flap valve, or alternative diaphragm, at the upper end of the accumulator, no spray is produced unless sufficient pressure is applied to overcome a biasing pre-load pressure; and any excess fluid is dumped back into the container through a small opening in the check valve.

A further advantage of the disclosed embodiments is that during fabrication the pattern of the spray can be controlled by how far the swirl chamber button is pushed into the chamber surrounding the spray nozzle. If the button orifice is moved closer to the plug on the nozzle housing, a wider spray pattern results, whereas when it is moved away from the plug, a narrower spray pattern results. In the case of the vertical spray dispensers, this feature is accentuated, since the deeper the swirl chamber button is compressed, the greater is the pre-load on the seal between the under skirt and the annular deflectable flange bearing on the inner periphery of the skirt. This relationship can be varied to suit the needs of specific customers, or to adapt the sprayer for specific types of fluids of higher or lower viscosity.

Another advantage of the sprayers of the present invention is that the sealing means provided at the top of the accumulator prevents atmospheric air from entering the mechanism to oxidize or otherwise deteriorate the product or to cause clogging or corrosion in any of the working parts. Further, no metal parts are in contact with the product; and such metal parts are therefore not subject to corrosion or chemical action from that source. A further advantage is that the sprayers of the present invention comprise a small number of parts which are easily and cheaply fabricated, and quickly assembled.

A still further advantage of these sprayers is that by removing the dip tube, the sprayer may be used in the inverted position. Operation in this manner allows the spray to be directed in a downward direction.

Other advantages of these embodiments are that the various flexible flanges allow uniform amounts of product to be dispensed upon each trigger depression, and prevent product from returning to the accumulator chamber once in the mixing chamber. Additionally, the flexible flanges also provide instant cut off, so that when pressure on the trigger is released, the flange will seal preventing the product from leaking out of the dispenser.

As used herein, "fluid product" is construed to include liquid or gas, or any flowable solution or a suspension in a liquid or gas carrier, or particulate matter, such as powder.

BRIEF DESCRIPTION OF THE DRAWINGS

FIGS. 16 and 17 show, respectively, a top plan view and vertical section of a modification of the horizontal trigger sprayer of the present invention; and FIG. 18 shows a vertical section of the horizontal spray-member of the present invention, in a position rotated 90° from its conventional upright position, specially constructed to be attached to the top of the vertical sprayer of FIG. 9A.

DETAILED DESCRIPTION

Figure 1A:
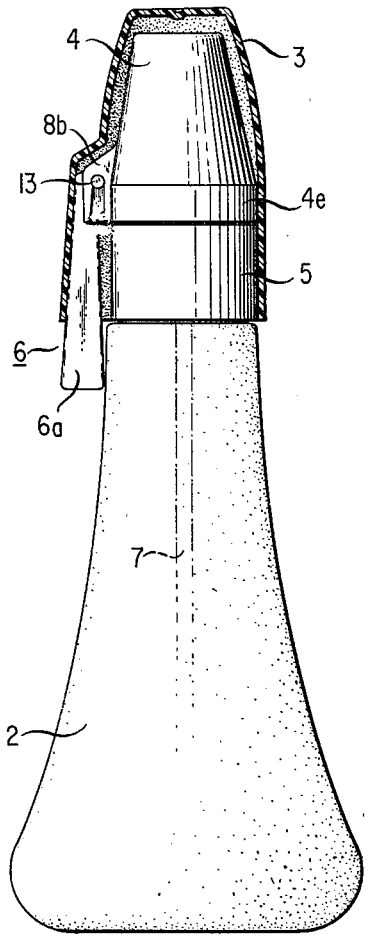
FIG. 1A is an overall side view of a vertical trigger sprayer in accordance with the present invention, with the over-cap sectioned to show the top with the trigger disposed on the left-hand side.

FIG. 1 A of the drawings shows, in perspective, an embodiment of the vertical trigger sprayer 1 of the present invention, in side elevation. This includes a small container 2, which may be formed of any type of rigid plastic, glass or other suitable material. In the present illustrative embodiment, this is formed of a semi-rigid plastic known as injection molded polypropylene, and is 15.50 cm. high, having a screw top mouth 2.54 cm. in diameter, and flaring out at the base to a diameter of 6.03 cm.

The vertical spray head attached to container 2 includes the accumulator housing 4, which will be described in detail hereinafter, and which is frustoconical in shape, having an internally screw-threaded skirt 4*e* at its lower end which snap-fits onto the lip of the internally screw-threaded top 5. In the present embodiment, accumulator housing 4 is about 3.15 cm. in overall height, 1.47 cm. in outer diameter across the top, and 2.5 cm. in outer diameter across the bottom, having a wall thickness of 0.13 cm. The skirt 4*e* at the lower end is about 0.58 cm. deep. Accumulator housing 4 may be formed of any type of rigid plastic well-known in the art. In the present example, it is of polypropylene.

In accordance with the present invention, the spray mechanism is operated by the trigger 6, which is also formed of polypropylene in the example under description, but may alternatively be formed of any of the plastic materials well-known in the art. Trigger 6 has a handle 6*a*, about 1.00 cm. wide and 0.50 cm. thick, which extends downwardly and outwardly about 3.74 cm., forming, in its rest position, a counterclockwise angle of about 30° with the principal axis of the container 2. The upper end of trigger 6 is bent inwardly at the top to form an internal bearing surface 6*b* which rotates in a vertical plane about the pivot 13. The latter is 0.25 cm. in diameter, and is mounted between the parallel supporting arms 8*a* and 8*b* extending out horizontally from accumulator housing 4. The lever arms 6*c* and 6*d*, at the upper end of trigger 6 (see FIG. 2A), function to raise a spring-biased piston 12 by contacting the underside of the annular piston flange 12*c* in a manner to be described in detail hereinafter with reference to FIG. 2B, thereby actuating the spray mechanism of the present device to suck up liquid from container 2 through the axially disposed dip-tube 7.

For the purpose of storage and transport, the spray mechanism of the present invention is equipped with a snap-on overcap 3. This is of generally hollow cylindrical shape, closed at the upper end, and formed of any rigid material, such as polypropylene. The internal cavity has a bulge at one side to accommodate the trigger 6 and hold it in unoperated position during storage or transport.

Figure 1B:
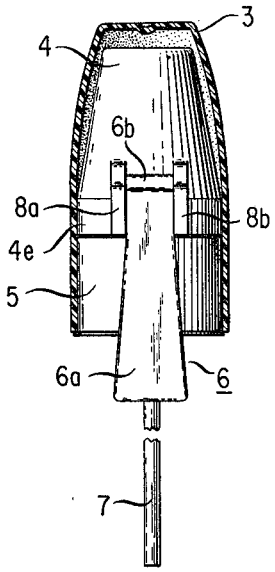
FIG. 1B shows the front view of the combination of FIG.1A, rotated through 90° in a counterclockwise direction, to show the trigger in end elevation.
Figure 2A:
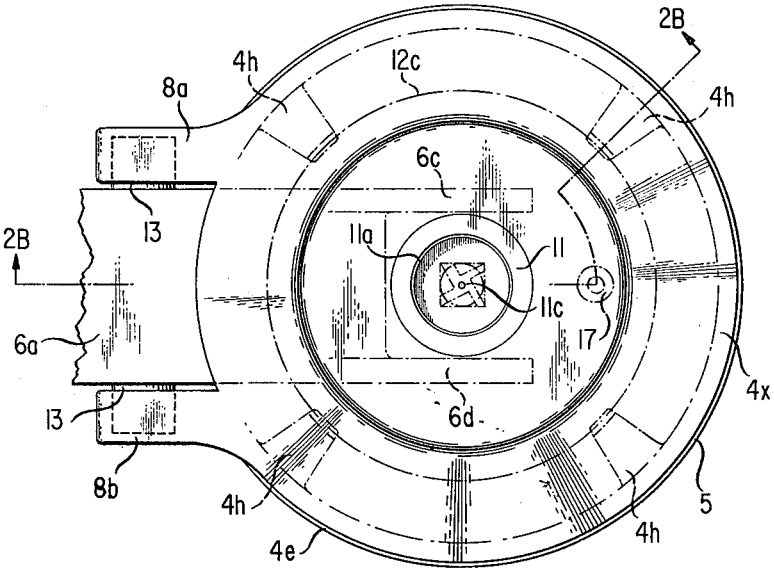
FIG. 2A is an enlarged top view of the vertical trigger sprayer of FIG. 1A with the cap removed.
Figure 2B:
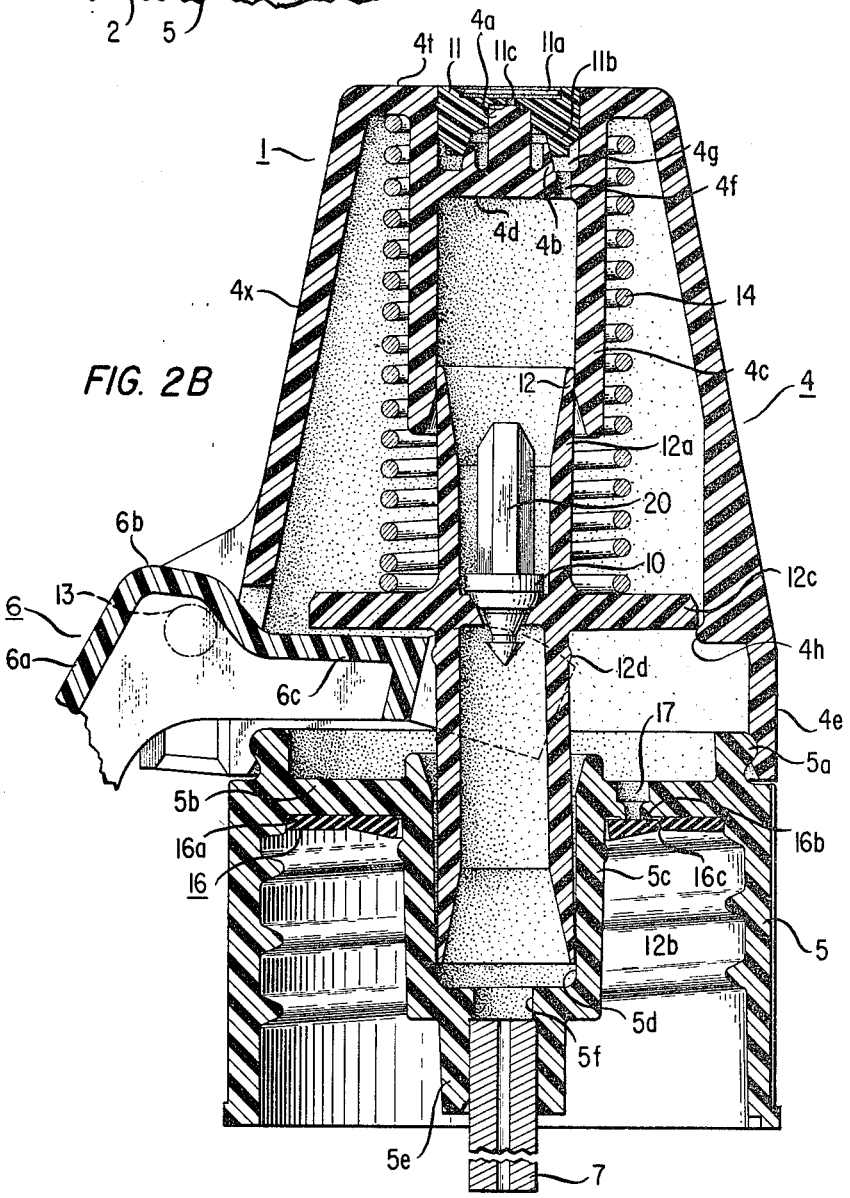
FIG. 2B is an enlarged vertical section of the top portion of the vertical trigger sprayer of FIG. 1A, taken along the planes indicated by the arrows 2B-2B of FIG. 2A.

Referring to FIGS. 2A and 2B of the drawings, the vertical trigger sprayer of FIGS. 1A and 1B, is shown in top view and in section, with the cap 3 removed.

The screw cap 5, on top of which the accumulator housing 4 is mounted, is of the same material as the latter, in the present example, but may be of any suitable plastic. As described, screw cap 5 is 2.54 cm. in outer diameter, 2.22 cm. in inner diameter, and 1.78 cm. deep along its axis, and has an internal lip 5*a* at the top, the outer diameter of which is 2.32 cm. and the inner diameter of which is 1.93 cm. Below the lip 5*a*, the top is conventionally screw-threaded in a manner to accommodate the matching screw-threaded mouth of container 2.

About 0.22 cm. below the top of lip 5*a* is a horizontally disposed annular closure 5*b* which coaxially surrounds and is integral with a downwardly directed stationary tube 5*c*. The latter is 0.91 cm. in outer diameter, forming an internal chamber 5*d*, 0.64 cm. in inner diameter, the wall of which is cut back in thickness at its upper end to form a slightly upwardly protruding flanged edge. Chamber 5*d* is 1.067 cm. deep, having a side and bottom wall thickness of 0.13 cm. Below the bottom of chamber 5*d*, and protruding downwardly coaxially from stationary tube 5*c*, is a tubular extension 5*e*, which is 0.56 cm. in outer diameter and 0.30 cm. in inner diameter, just accommodating the upper end of the axially extending dip-tube 7 which brings up product from container 2 to chamber 5*d* through a central opening 5*f*, which is 0.28 cm. in diameter, through its bottom wall. In the present embodiment, the dip-tube 7 has an internal diameter of 0.05 cm.

Mounted to reciprocate in coaxial relation to chamber 5*d* is a tubular piston 12, slightly tapered at the ends, which in the present embodiment is 2.72 cm. in vertical extent, and has a maximum outer diameter of 0.63 cm., except for flange 12*c*. The upper end 12*a* is 1.04 cm. long, and the lower end 12*b* is 1.55 cm. long, the two sections being separated by the laterally extending annular flange 12c which is 0.13 cm. thick and 1.78 cm. in outer diameter, forming internally at its center a valve seat for the check valve 10, as will presently be described. The valve seak takes the form of an inverted frustoconical opening having a diameter of 0.33 cm. across the top and tapered to a diameter of 0.17 cm. across the bottom.

The tubular walls of upper and lower sections 12a and 12b are 0.10 cm. thick, being tapered about 0.45 cm. from their respective ends to a thickness of 0.03 cm. Centered about 0.13 cm. below the lower face of flange 12c is slightly protruding ring 12d.

As previously indicated, the upper end 4x of accumulator housing 4 is frustoconical in form, being designed with a cylindrical skirt 4e at its lower end having an annular indentation just above its lower edge which engages the lip 5a of screw cap 5. Accumulator housing 4 is 2.54 cm. in overall diameter across cylindrical skirt 4e, 3.15 cm. high, including skirt 4e, and 1.50 cm. across the top 4t. The cylindrical lower skirt portion 4e extends 0.58 cm. vertically.

Referring to FIG. 2A, on the left-hand side, the pair of arms 8a, 8b, each about 0.28 cm. wide, extend laterally about 0.5080 cm. out from the periphery of 4e. The arms 8a, 8b serve to support the pivot bar 13, about which the trigger 6 operates, as will be described. From the upper end of 4e, the frustoconical wall 4x of accumulator housing 4 forms an inwardly directed angle of about 12.5° with a line parallel to the axis. From the flat top 4t of accumulator housing 4, stationary internal accumulator cylinder 4c extends axially into the hollow interior of outer wall 4x. The accumulator, comprising a stationary tube 4c has an overall diameter of 0.91 cm., a wall thickness of 0.13 cm. and extends 1.60 cm. downward in an axial direction. The wall of the tube comprising accumulator 4c is tapered, beginning 0.14 cm. above its lower end, to a wall thickness of 0.06 cm.

The upper end 12a of the hollow piston 12 is accommodated for reciprocating motion in slidable relation to the internal wall of the stationary tube comprising accumulator 4c, operating against the tension of the coil spring 14 which surrounds 4c. Coil spring 14 is held in place between the inner surface of the accumulator housing top 4t and the upper face of hollow piston flange 12c. The coil spring 14 may comprise, for example, 20 coils of galvanized piano wire, which has been wound to form a helix 1.14 cm. in outer diameter. In its rest position, coil spring 14 has sufficient resilience to hold the annular flange 12c in contact with the internal abutting members 4h, which are four stops, each forming an arc about 0.15 cm. across its inner end and symmetrically spaced apart around the inner periphery at the upper end of the cylindrical skirt 4e, and projecting radially 0.27 cm., as shown in FIG. 2A.

Force-fit into the upper end of the inside of the stationary tube comprising accumulator 4c is the spray button 11, which is cylindrical in overall shape, having an outer diameter of 0.64 cm. This is snapped into place by means of projecting lips. Its upper edge is flush with the annular upper surface 4t of accumulator housing 4, the side walls extending down 0.25 cm. in contact with the inner walls of the stationary tube comprising accumulator 4c. In the present embodiment, the button 11 is of an acetal cpolymer known by the trademark CELCON 141 of Celanese Corporation. Alternatively, other materials in the nylon family, having similar characteristics, such as a product manufactured by E. I. duPont de Nemours under the trademark DELRIN, or other plastic materials, such as polystyrene or polypropylene, are suitable for this purpose. Button 11 is recessed at the top to form a shallow cylindrical opening 11a which is 0.46 cm. in diameter and 0.06 cm. deep. The latter surrounds coaxially a central opening 11c which is 0.03 cm. in diameter and about 0.04 cm. deep.

Figure 5A:
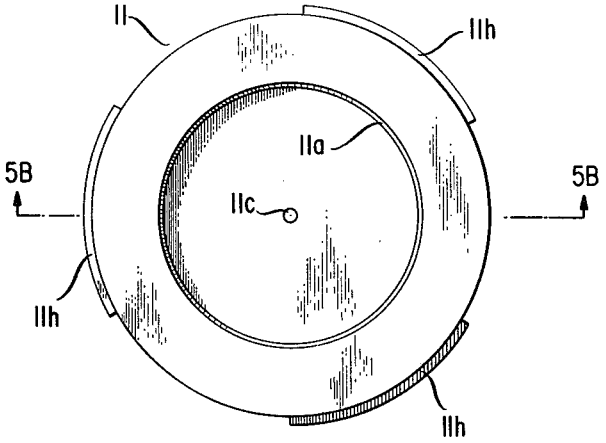
FIG. 5A is a detailed, enlarged showing, looking down from the top, on spray button 11, indicated in FIG. 2B.
Figure 5B:
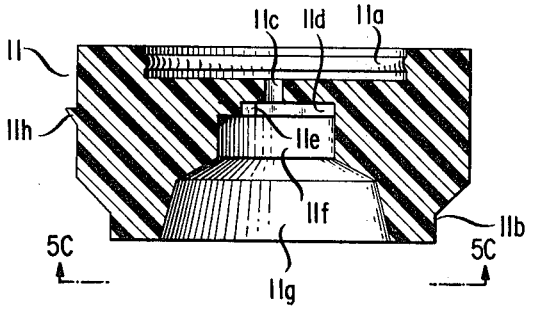
FIG. 5B is an enlarged, detailed, cross-section of spray button 11 along the planes indicated by the arrows 5B—5B of FIG. 5A.
Figure 5C:
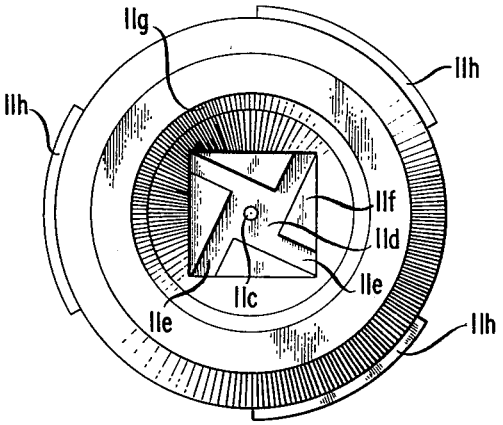
FIG. 5C is an enlarged showing of spray button 11, looking up from the bottom of FIG. 5B.

Referring to FIGS. 5A, 5B and 5C, which respectively show button 11 in plan view, in section, and looking up from the bottom, it is seen that opening 11c leads into a square swirl chamber 11d, 0.10 cm. on a side and 0.02 cm. deep, having four swirl arms 11e, each 0.03 cm. wide and of the same depth, which extend out rectangularly from each of the corners of the square 11d. The latter are surrounded coaxially by a larger rectangular chamber 11f, which is 0.19 cm. square, and which extends vertically 0.08 cm. deep. The axis of inner square 11d is rotated 22.5° in a horizontal plane relative to the axis of outer square 11f, so that the arms 11e lead out to the corners. The lower end of the button 11 extends downward a vertical distance of 0.32 cm. from its upper surface to form an annular skirt 11b which has an outer diameter 0.56 cm. and an inner diameter 0.38 cm. at its lower end at the opening of chamber 11g, which is round at its lower end and is cut back to surround rectangular chamber 11f.

Referring again to FIG. 2B, centered 0.4 cm. from the top accumulator housing 4 in the stationary accumulator tube 4c, and disposed just below the button 11, is a horizontal circular partition 4d which is 0.12 cm. thick. Protruding up vertically from the center of 4d is a cylindrical plug 4a, 0.19 cm. in diameter and 0.27 cm. high, as measured from the upper surface of 4d. Cylindrical plug 4a is seated in the rectangular opening 11f of button 11, so that the sides of 4a are tangent to the centers of the four sides of opening 11f. Plug 4a has a tiny rounded boss protruding from the center of its top. This boss engages the underside of the opening 11c in sealing relation against atmospheric air, responsive to be forced aside to release liquid product forced up from the swirl chamber 11d.

A particular feature of the present invention is the upwardly directed annular flexible flange 4b attached to the upper surface of 4d. At its lower end, in contact with 4d, flange 4b has an outer diameter of 0.41 cm. and an inner diameter of 0.31 cm. giving it a thickness of 0.05 cm. The flange 4b extends 0.13 cm. above the surface of 4d, being slightly frustoconical in shape, so that its thickness tapers to 0.02 cm. at the upper end. The flange 4b fits into and bears against the inwardly directed annular surface of the skirt 11b. At an eccentric position around the annular space on partition 4d, between the inner wall of the accumulator comprising stationary tube 4c and the flange 4b, is a circular opening 4f through which product liquid is forced up, upon depression of the trigger 6, from the inner chamber of accumulator tube 4c, into the outer annular chamber 4g. The pressure of the liquid inwardly deflects the flange 4b from the inner surface of skirt 11b, permitting product to flow into the chamber surrounding cylindrical plug 4a. The product is forced upward between the walls of plug 4a and the corners of rectangular chamber 11f, into the swirl arms 11e, and is dispensed through the opening 11c.

Figure 3C:
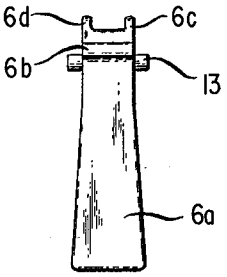
FIGS. 3A, 3C and 3B show, respectively, in side elevation, and front elevation and top view, the trigger mechanism of FIGS. 1A, et seq.
Figure 3B:
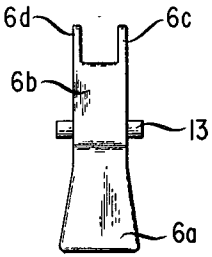
Figure 3A:
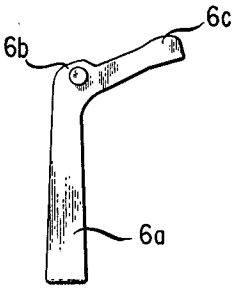

The trigger 6, at the left-hand side of the sprayer shown in FIGS. 1A, 2A, 2B, and in more detail in FIGS. 3A, 3B and 3C, has a downwardly extended operating arm 6a, which is integrally formed at its upper end with an inwardly directed shoulder 6b, which is mounted to bear on the pivot 13, raising and lowering the levers 6c and 6d which extend along a horizontal plane on opposite sides of tube 12b, beneath the annular flange 12c. See FIG. 2A.

In the embodiment under description, the trigger arm 6a is 0.50 cm. wide in a vertical sectional plane, and is directed downward from the bearing shoulder 6b, providing a left-hand lever arm distance of 3.56 cm. to the pivot center 13, and when installed on the spray dispenser, forming an external angle of about 30° with a vertical line parallel to the principal axis of container 2. The levers 6c and 6d, which extend horizontally inward from shoulder 6b, are each 1.00 cm. wide across the top and are spaced apart 0.60 cm., providing rounded upper contact surfaces which bear on the under surface of flange 12c on opposite sides of the downwardly extended tube 12b. The right-hand lever arm distance btween the pivot point 13 and the tangential areas of contact of levers 6c and 6d with the underside of the flange 12c is 1.30 cm. in the present embodiment. This provides a multiplication ratio of about 3 between manual force applied by the user at the lower end of 6a and the aggregate force applied by the two levers 6c and 6d at their points of tangency with the underside of flange 12c.

When levers 6c and 6d contact the underside of the annular flange 12c, piston 12 is raised against the tension of spring 14, expelling any product in the accumulator tube 4c. Conversely, when trigger member 6a is released, members 6c and 6d return, releasing the flange 12c from the compression of spring 14, reducing the pressure in accumulator 4c. This cuases check valve 10 to open in response to the pressure of product sucked up through the dip tube 7. Thus, as trigger arm 6a is repeatedly depressed, the tube 12 is caused to move with reciprocating motion along the axes of the upper and lower stationary tubes 4c and 5c, causing in alternation the seating and unseating of the valve head 10 in its seat in flange 12c. It will be noted that the accumulator housing 4, in combination with the container closure 5, remains stationary during this process.

The valve head 10 and cruciform valve stem 20 are preferably of low density polyethylene. A check valve of this general form is shown and described in detail with reference to FIGS. 5A, 5B and 5C of my U.S. Pat. No. 4,057,176, issued Nov. 8, 1977. The upper end of valve head 10 comprises a cylindrical wafer formed coaxially with which is a truncated spheroid. Appended in coaxial relation to the latter is a frustum of a cone of decreasing diameter between its upper and lower ends. This terminates in a cylinder on the lower end of which is mounted a cone of elliptical cross-section, extending downward to an apex.

The valve stem 20 is also of low density polyethylene, in the present example, although it may be of other suitable material. It is 0.69 cm. in maximum vertical length, and extends up vertically in coaxial relation to the center of valve head 10. As clearly shown in FIG. 5B of my U.S. Pat. No. 4,057,176, supra, the cross-section of 20 is cruciform. At the top of the stem, one pair of legs is recessed relative to the other, to aid in initially orienting the valve head 10 in the valve seat at the center of 12c.

As point out in my earlier patent, supra, it will be understood that instead of being cruciform in cross-sectional shape, as shown in FIGS. 5A and 5B of the said patent, the valve stem 20 can assume other forms, such as shown and described, for example, in FIGS. 5C and 5D of the said patent.

Centered 0.15 cm. in a radial direction from the inner wall 5c is an opening 17 in the screw top 5b, leading from the atmosphere into product container 2. Opening 17 is 0.15 cm. in diameter across the top, being constricted about halfway through to a diameter of 0.07 cm.

Figure 4C:
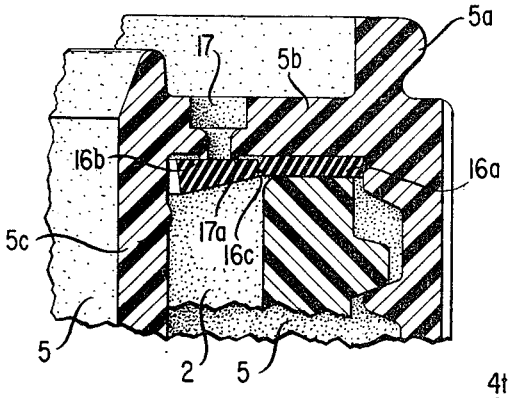
FIG. 4C is an enlarged, detailed showing, in partial diametrical section through opening 17, of the hinged gasket 16 in place between the screw cap and the container top.
Figure 4A:
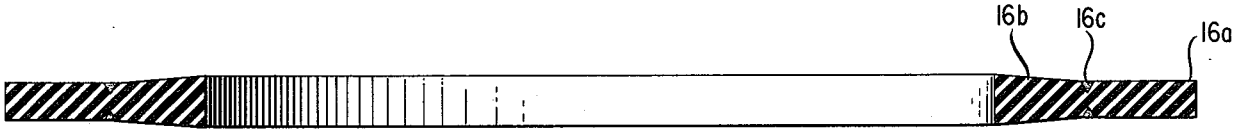
FIG. 4A is an enlarged, detailed, diametrical cross-section of the molded gasket 16 of FIG. 2B, comprising valve seal with hinge.
Figure 4B:
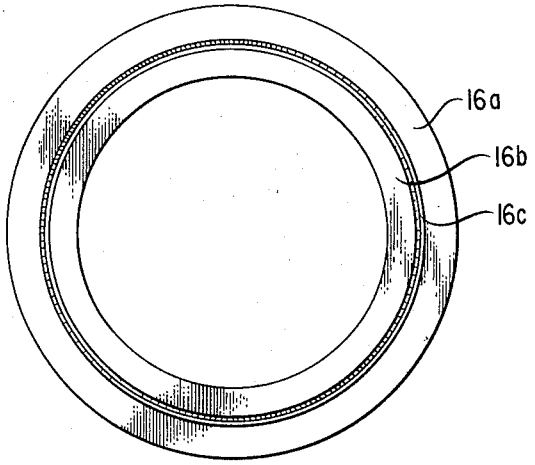
FIG. 4B is a top, horizontal, planar view of the gasket 16, shown in FIG. 4A.

A particular feature of the present invention is the hinged gasket 16 of FIG. 2B, which is shown in enlarged detail in FIGS. 4A and 4B of the drawings, and is in place between the screw top 5 and the top of container 2, in FIG. 4C.

Hinged gasket 16 is annular in form, having an outer diameter of 1.98 cm. and an inner diameter of 0.95 cm., and is formed of sheet elastomer, such as, for example, low density polyethylene, although it will be understood that this gasket can be formed of other elastomeric material having similar characteristics. The inner and outer annuli 16a and 16b of gasket 16 are separated by a circular hinge 16c, which is 1.43 cm. in diameter, and is formed by matching 60° angular notches directed inwardly from the upper and lower surfaces of gasket 16, leaving between their notches a thickness of 0.03 cm. Outer annulus 16a is uniformly 0.06 cm. thick. The inner annulus 16b is tapered from a thickness 0.06 cm. at the hinge to 0.11 cm. at its inner edge.

The lower end of the opening 17, which is 0.07 cm. in diameter, is centered 0.11 cm. from the inner edge of the annulus 16b. Surrounding the mouth at the lower end of 17 is a small annular ring 17a about 0.13 cm. in outer diameter, protruding from the face of the opening about 0.01 cm. See FIG. 4D. As shown in FIG. 4C, 16a is held in place by the upper edge of the container 2, when the latter has been screwed in place in the top 5. This leaves 16b free to move as a flap valve about the hinge 16c. When the internal pressure in container 2 equals or exceeds atmospheric pressure, the annular flap 16b is held tightly against the underside of 5b, securely sealing against raised ring 17a surrounding the opening 17. As soon as air pressure in the container 2 is reduced below atmospheric pressure, the annular flap 16b moves inward, and is unseated from the raised ring 17a, admitting sufficient air to bring the internal pressure up to atmospheric pressure. When this occurs, the flap 16b again seats against the raised ring 17a, sealing the container 2.

Figure 4D:
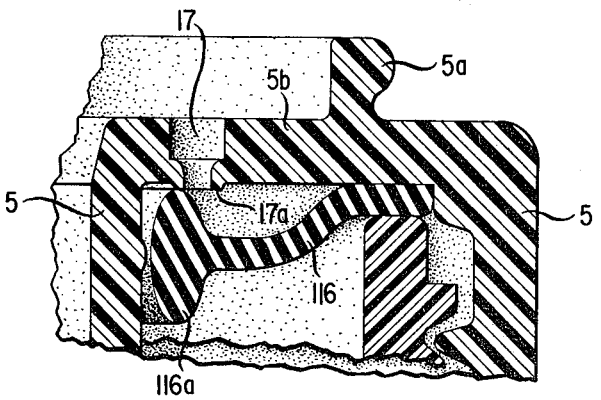
FIG. 4D is an enlarged, detailed showing, in partial diametrical section through opening 17, of a modified form of the hinged gasket 16.

An alternative form of gasket is shown in FIG. 4D, in which the gasket 16 is replaced by the gasket 116. The latter broadens out at its extreme inner end into an annular flange 116a of elliptical cross-section, which is vertically extended above and below the body of 116. When the container 2 squeezes the outer end of 116 against the underside of the top 5b of the screw cap 5, the upper end of 116a also makes contact with 5b, sealing out any air passing into container 2 through the opening 17, except when the pressure in container 2 is below atmospheric pressure. In that case, 116a is deflected, letting air into container 2.

Operation of the embodiment described with reference to FIGS. 2A, 2B is as follows:

The user depresses the trigger arm 6a, thereby causing the levers 6c and 6d to move upward, contacting the underside of the flange 12c. The piston 12 is impelled to move vertically up, against the compression of the spring 14, forcing any remaining product out of stationary upper accumulator tube 4c, and up through the opening 4f, into the annular chamber 4g. The product in the chamber 4g exerts a pressure on the annular flange 4*b*, deflecting it inward to unseal from the inner wall of skirt 11*b*. Product then surrounds the cylindrical plug 4*a*. (See, FIGS. 5A, 5B and 5C.) Product is forced up under pressure through the corners of the rectangular chamber 11*f*, and from each of the corners through the swirl arms 11*e* into the swirl chamber 11*d*, thereby creating turbulence in the product fluid and breaking up any conglomerates. The high pressure product mist is then dispensed through the central opening 11*c*.

A particular feature of this arrangement is the flange 4*b* which seals against the internal periphery of the resilient skirt 11*b*, and can only be deflected inward. Thus air is prevented from flowing back into the system through the opening 4*f*, to possibly oxidize and dry up the product, and cause stoppages in the spray mechanism.

As previously pointed out, one of the advantages of the device of the construction herein described is that during fabrication, the position of the spray button 11 in the cavity 4*g* can be critically positioned, so that depending on the character of the product, the angle of the spray pattern is made wider or narrower; and the product is dispensed at greater or lesser pressure. The deeper the button 11 is interposed in fixed relation to the skirt of plug 4*a*, the wider will be the spray pattern, and the more pressure will be required for product to deflect the flange 4*b*.

Another advantage, as previously pointed out, is the leverage which is obtained by lengthening the trigger arm 6*a* relative to the levers 6*c*, 6*d*. Hence, a relatively small amount of force applied by the palm of the user's hand to trigger arm 6*a* is multipled effectively at the point of contact between the lever arms 6*c*, 6*d* and the underside of piston flange 12*c*.

Figure 6B:
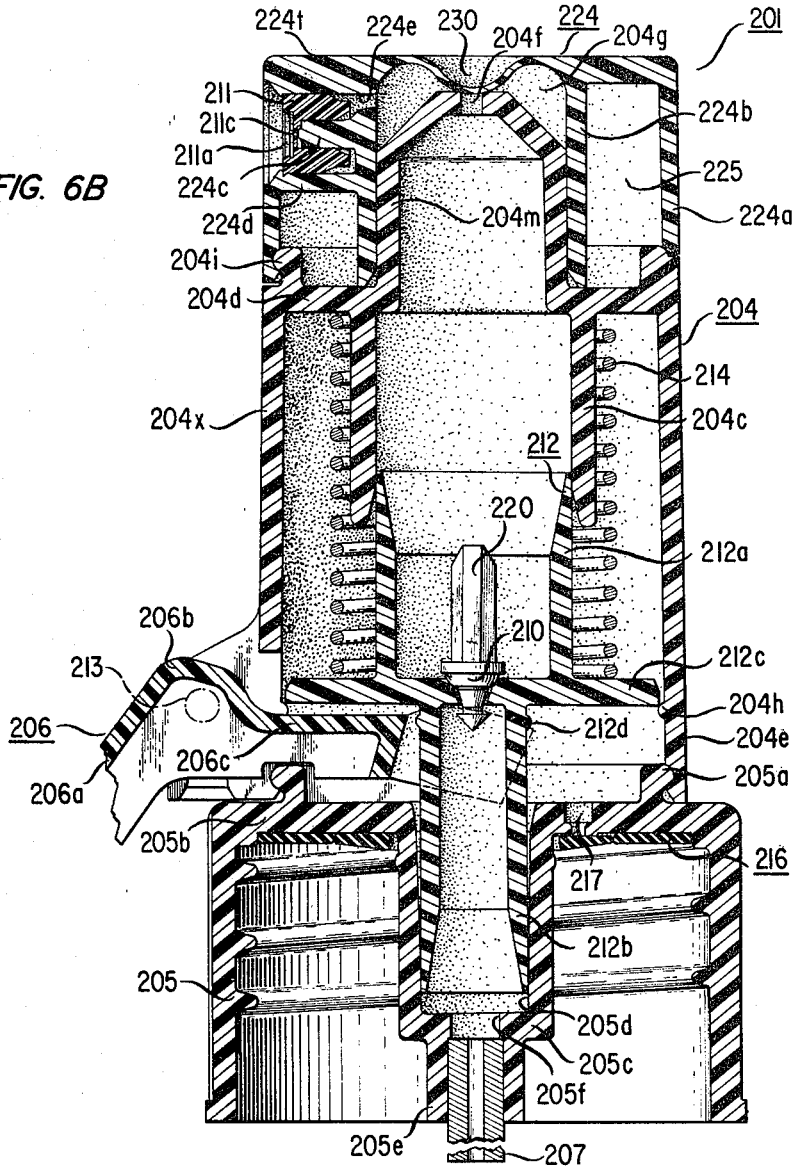
FIG. 6B is an enlarged, vertical section, along the plane 6B—6B of FIG. 6A, of the horizontal trigger sprayer.
Figure 6A:
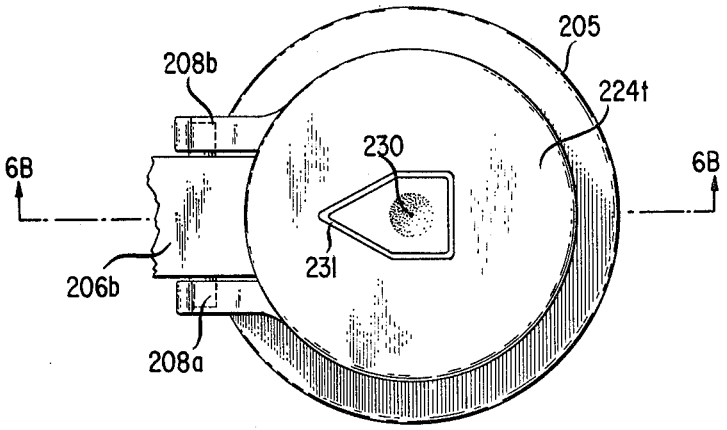
FIG. 6A is a plan view, looking down from the top, of a horizontal trigger sprayer in accordance with the present invention.

A modified form of the trigger sprayer, in which the spray is dispensed horizontally instead of vertically, as in the sprayers shown in the earlier figures, is shown in enlarged top view in FIG. 6A, and in enlarged vertical section in FIG. 6B.

The lower portions of the sprayer of FIG. 6B, including the screw top 205, the piston 212 and the trigger mechanism 206, are substantially similar to the structures shown in FIG. 2B, and may be formed of the same or similar plastic materials. In order to simplify the description with reference to FIGS. 6A and 6B, 200 will be added to the reference characters of elements similar to those of FIGS. 2A, 2B. Elements bearing corresponding numbers are substantially similar, unless otherwise stated. For example, the trigger 206 of FIG. 6B is substantially similar in form to trigger 6 of FIG. 2B. Some of the other elements of FIG. 6B are similar in form, but different in dimension to corresponding elements of FIG. 6B; and those differences will be pointed out as the description proceeds.

In the embodiment of FIGS. 6A, 6B, the internally screw-threaded top 205, which screws onto the mouth of a container similar to container 2 in FIG. 1A, is 3.17 cm. in outer diameter, 2.80 cm. in inner diameter, and 1.90 cm. in vertical depth, and has a lip 205*a* at the top, the outer diameter of which is 2.34 cm., and the inner diameter of which is 1.96 cm., in the present example.

About 0.22 cm. below the top of lip 205*a*, is an annular closure 205*b*, which surrounds a stationary central tube 205*c*, as in the earlier example. Cylindrical inner chamber 205*d* of the tube 205*c* is 1.24 cm. deep and 0.64 cm. in inner diameter, having a side and bottom wall thickness of 0.13 cm. Below the bottom of chamber 205*d*, and protruding downward coaxially from stationary tube 205*c*, is a tubular extension 205*e*, which is 0.56 cm. in outer diameter and 0.32 cm. in inner diameter, just accommodating the upper end of dip-tube 207. The latter rests against a shoulder which coaxially surrounds a 0.28 cm. diameter opening 205*f* in the bottom wall of chamber 205*d*. The inner diameter of dip-tube 207 is 0.15 cm.

As in the earlier-described embodiment, the tubular piston 212 is mounted to reciprocate in coaxial relation to chamber 205*d*. In the presently described embodiment, the piston 212 is 3.09 cm. in overall extent along the vertical axis of the sprayer. Unlike the previously described embodiment, the upper and lower piston sections 212*a* and 212*b* may be of the same or different diameters, the two sections being separated by the annular lateral flange 212*c*. In this embodiment, 212*c* is 2.19 cm. in outer diameter and 0.15 cm. in thickness, having as its center a valve seat for check valve 210. The valve seat takes the form of an inverted frustoconical opening having a diameter of 0.32 cm. across the top, and tapered to a diameter of 0.18 cm. across the bottom.

The lower piston tube 212*b* extends 1.73 cm. below the lower face of 212*c* and is 0.64 cm. in outer diameter and 0.39 cm. in inner diameter. Centered 0.13 cm. below the face of 212*c* on 212*b* is a small annular ring 212*d*. The outer wall of 212*b* engages in reciprocating relation with the stationary cylindrical inner chamber 205*d*.

The upper piston tube 212*a* extends 1.21 cm. above the upper face of 212*c*, and is 1.14 cm. in outer diameter and 0.91 cm. in inner diameter. As in the previously described embodiment, the upper end of 212*a* and the lower end of 212*b* are tapered.

The accumulator housing 204, which snap-fits onto screw top 205, is cylindrical in form, the outer wall 204*x* being 2.48 cm. in outer diameter, and 2.23 cm. in inner diameter, and 3.18 cm. in overall height.

On the left-hand side of accumulator housing 204, as shown in FIG. 6A, and protruding laterally 0.70 cm. at their centers from the periphery of 204*x*, are a pair of arms 208*a*, 208*b*, each about 0.30 cm. wide, which serve, as in the previous embodiment, as mountings for the pivot 213 on which the trigger 206 is mounted to rotate. The latter includes an actuating arm 206*a*, a shoulder 206*b* and horizontal levers 206*c* and 206*d*, all substantially similar in structure and function to their counterparts in FIG. 2B. The trigger 206, which includes downwardly extended operating arm 206*a*, the shoulder 206*b* bearing on pivot 213, and the horizontally extended levers 206*c* and 206*d*, operates to vertically raise and lower the piston 212 by contacting the underside of flange 212*c*, in exactly the manner of the trigger 6 described with reference to FIG. 2B, operating to raise and lower the piston 212. This occurs without any movement of the container closure 205, accumulator housing 204, or nozzle housing 224.

An inner ring 204*h*, serving as a stop is centered 0.56 cm. above the lower end of skirt 204*e*. This functions to engage the underside of flange 212*c* to prevent the piston 212 from moving further down in response to the pressure of coil spring 214. At the bottom of skirt 204*e* is a recess which engages the lip 205*a* in snap-on relation.

Mounted coaxially inside of the outer tube 204*x* is the accumulator comprising stationary inner tube 204*c* which is 1.42 cm. in outer diameter, 1.14 cm. in inner diameter and extends 1.25 cm. vertically down from an annular closure 204*d*, 0.15 cm. thick, which connects the accumulator comprising inner tube 204*c* to the top of outer tube 204*x*. The upper end of piston tube 212*a* engages and slides vertically along the stationary inner wall of accumulator tube 204*c*.

Surrounding the inner accumulator tube 204*c* is a helical coil 214, similar to coil 14 of FIG. 2B, which is held in place between the underside of 204*d* and the upper face of flange 212*c*. This tends to press flange 212*c* against the stop member 204*h*, except when the flange 212*c* is moved vertically upward by actuation of the trigger arm 206*a*.

The valve 210, valve stem 220, and valve seat, centered in the flange 212*c*, are substantially the same in structure and operation as the corresponding elements described with reference to FIG. 2B. Thus, when trigger arm 206*a* is depressed, the levers 206*c* and 206*d* contact the underside of flange 212*c*, moving the piston 212 up against the tension of the spring 214, and forcing any product out of accumulator tube 204*c*. When the piston 212 returns to its normal or rest position, the partial vacuum created causes the valve 210 to be raised off of its valve seat in response to the pressure of product sucked up through the dip tube 207.

An annular lip 204*i* protrudes vertically about 0.22 cm. near the outer edge of the partition 204*d* at the accumulator housing, which lip serves to secure the nozzle housing 224 in place.

At the inner periphery of 204*d*, extending up coaxially from the upper end of accumulator tube 204*c*, is a partly cylindrical enclosure 204*m*, 1.12 cm. in outer diameter, and 0.86 cm. in inner diameter, the vertical cylindrical wall extending 0.79 cm. from the top of 204*d*. The upper end of 204*m*, above the cylindrical portion, is frustoconical in section, having a wall thickness 0.13 cm., forming an inwardly directed angle of about 50° with the vertical portion of the wall, so that the enclosure is 0.41 cm. across the top, and has a central opening 204*f*. The latter is 0.13 cm. in diameter.

The nozzle housing 224, which is formed of any suitable flexible plastic material, such as low density polyethylene, snap-fits onto the accumulator housing 204 by means of a depression in its lower cylindrical side-wall 224*a*. Sidewall 224*a* is 2.44 cm. in outer diameter, 2.23 cm. in inner diameter and 1.34 cm. in overall height.

Integral with the closed top 224*t* is an internal tube 224*b*, surrounded coaxially by 224*a*. Tube 224*b* is 1.33 cm. in outer diameter, 1.12 cm. in inner diameter and extends 1.35 cm. vertically down from the top 224*t*, just accommodating the tube 204*m* in coaxial relation. The annular portion of 224*t* between the tubular walls 224*a* and 224*b* varies from a thickness of 0.13 cm. on one side of the top to a thickness of 0.22 cm. on the other side, adjacent the laterally directed swirl chamber 211*d*, where the spray emerges.

Centered on the opening 204*f*, in the form of a hollow semispheroid pressing against the opening with a tangential pressure of, say 2.1 kilograms per square centimeter (30 pounds per square inch) is a diaphragm 230, which is 0.04 cm. thick. An annular chamber 204*g* is created between diaphragm 230 and the conical upper end of 204*m*.

Figure 7A:
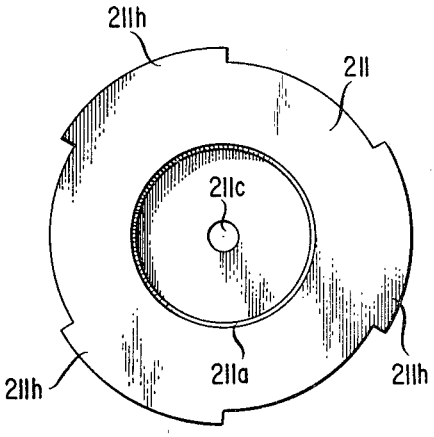
FIGS. 7A, 7B and 7C show, respectively, detailed enlarged showings of a top view, button view and diametrical section of the swirl chamber 211.
Figure 7B:
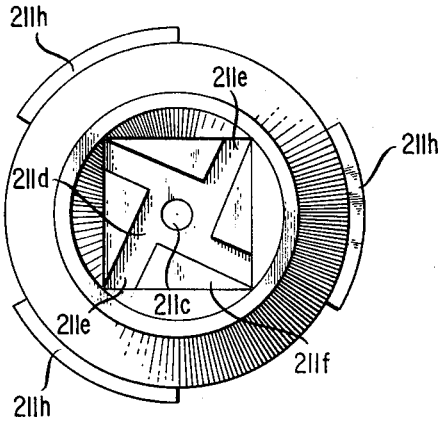
Figure 7C:
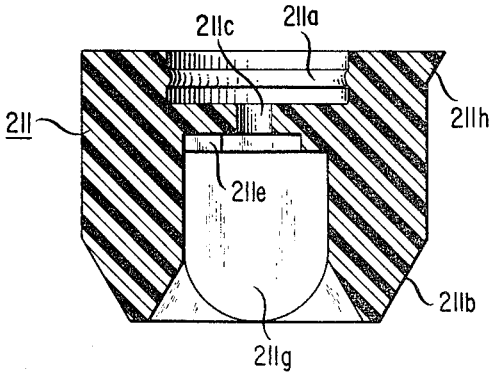

At the side of the nozzle housing 224, a laterally directed compartment is formed between the tubes 224*a* and 224*b*, comprising insert 224*d*, having a lower wall section 0.10 cm. thick, the insert being vertically aligned with the trigger 206. The insert 224*d* is mounted between tubes 224*a* and 224*b*, and its upper surface is 0.68 cm. down from the top 204*t*. As measured in the plane of the drawing, 224*d* extends 0.46 cm. along the sides, and 0.66 cm. in a direction normal to the plane of the drawing, which is tangential to the outer periphery of 204*m*. Between insert 224*d* and the under surface of 224*t* is formed a laterally extending cylindrical cavity 224*e*, having an internal diameter 0.46 cm., as measured vertically across the central portion. Coaxial with cavity 224*e* is a round lateral opening 0.58 cm. in outer diameter, cut in the sidewall 224*a*. The round, lateral opening accommodates a swirl chamber housing 211, which is interposed into the cylindrical cavity 224*e*, as shown in FIGS. 7A, 7B and 7C of the drawings.

Swirl chamber housing 211 is 0.46 cm. in diameter and 0.245 cm. deep along the sidewall, the inner end being tapered to form an annular skirt 211*b*, 0.06 cm. wide at the edge, and extending inward a total depth of 0.38 cm. from the lateral face of 211. The latter has a shallow cylindrical opening 211*a*, 0.25 cm. in diameter, at the center of which is a perforation 211*c*, 0.025 cm. in diameter, for release of product. This leads into a square swirl chamber 211*d* of substantially the form described with reference to FIG. 2B, having four swirl arms 211*e* leading into the corners of a larger square chamber 211*f*, which extends laterally about 0.22 cm. in depth.

Interposed into this square chamber 211*f* as shown in FIG. 6B, is a laterally extending cylindrical plug 224*c*, which is integral with a vertical arm of insert 224*d*. Plug 224*c*, which has its central axis 0.34 cm. above the lower surface of insert 224*d*, is 0.15 cm. in diameter and extends 0.45 cm. out from the inner wall of 224*b*. Plug 224*c*, which is similar in form to 4*a* of FIG. 2B, has a small boss at the center of its external end surface. which presses against the inner surface of opening 211*c*.

Operation of the embodiment of FIGS. 6A, 6B is as follows. When the user depresses the trigger arm 206*a*, directing the spray nozzle as indicated by arrow 231, the lever arms 206*c*, 206*d* are actuated, pressing against the underside of flange 212*c*, and raising the piston 212 vertically against the compression of the spring 214. This forces any remaining product out of tube 204*c* and up through tube 204*m*, where the pressure of product forces the diaphragm 230 to be raised off of opening 204*f*. The product is then forced into the annular chamber 204*g*, from which it passes into the laterally extending cylinder cavity 224*e*. The product is then forced out through the spaces between the corners of the rectangular cavity 211*f* and the cylindrical plug 224*c*, passing into swirl chamber 211*d* through the swirl arms 211*e*, and out through the dispensing opening 211*c*. (See FIGS. 7B and 7C)

As stated with reference to the previously described embodiment, a particular advantage of the device here described is that the angle of the spray pattern can be controlled during the fabrication process by the depth at which swirl button 211 is interposed and fixed in the cavity 224*e*, by means of snap connectors 211*h*.

Figure 8A:
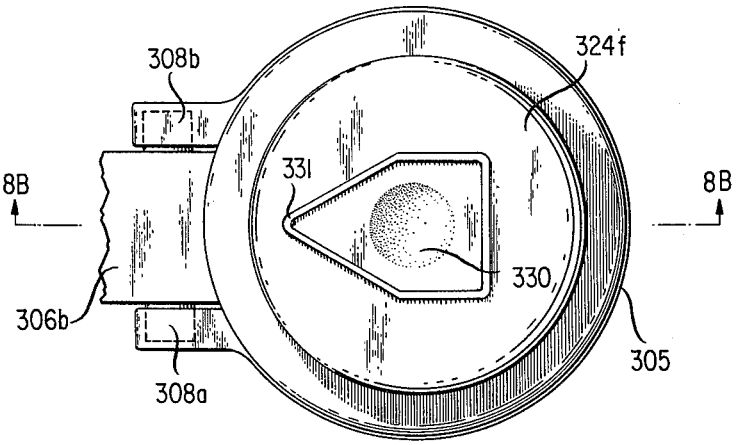
FIGS. 8A and 8B show in plan view and vertical section, respectively, a horizontal trigger sprayer especially modified to include an air compression chamber for use with a high viscosity product.
Figure 8B:
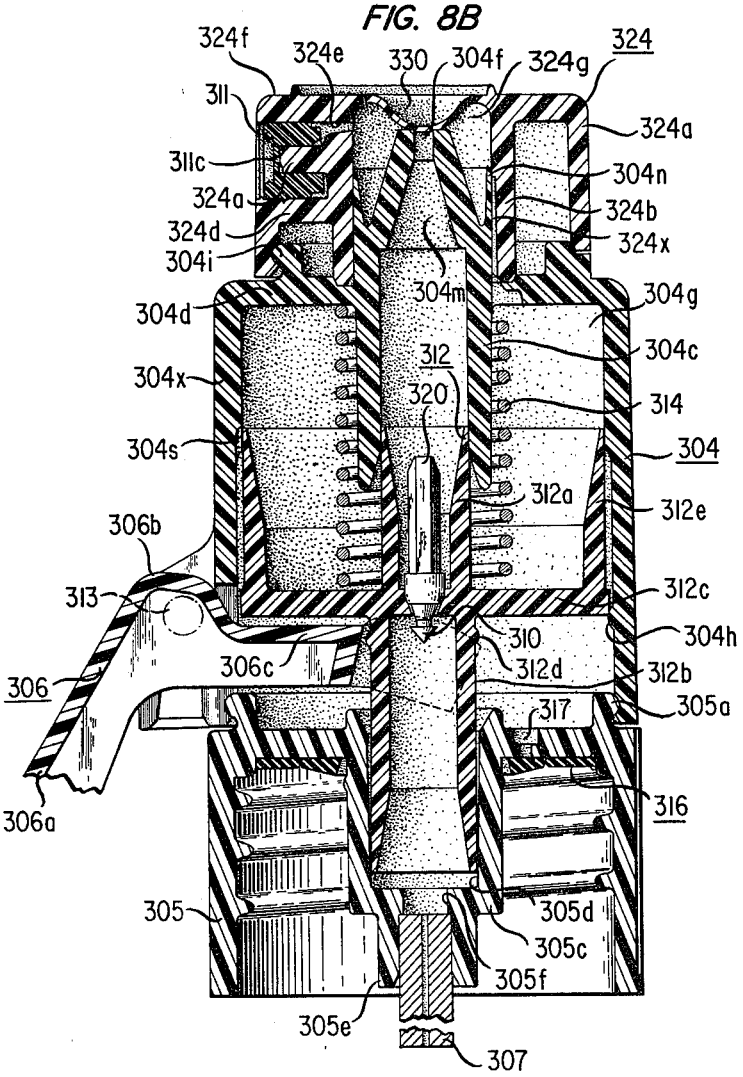

A further embodiment of the invention is shown in FIGS. 8A and 8B of the drawings which is specially adapted to break up a high viscosity product, such as cooking oil, or the like, or to produce a dry spray, both of which operations require a high volume air and product mixture, in which, for example, from 10 to 30 parts of air are mixed with one part of liquid, or other product, such as powder.

As in the previous embodiments shown and described with reference to FIGS. 6A and 6B, the lower portions of the sprayer of FIGS. 8B, including the screw cap 305, the lower end 312*b* of the piston 312 and the trigger mechanism 306, are substantially similar to the structures shown in FIG. 2B. The device may be formed of the same or similar plastic materials; as the embodiments previously described. For simplification of the description with reference to FIGS. 8A and 8B, 300 will be added to the reference characters of elements similar to those of FIGS. 2A and 2B. Elements bearing corresponding numbers are substantially similar, unless otherwise stated. For example, the trigger 306 of FIG. 8B is substantially similar in form to trigger 6 of FIG. 2B. Any difference as to form and/or function of the elements will be pointed out as the description proceeds.

In the embodiment under description, the accumulator housing 304 is modified to provide for an aircompression chamber 304*g*, which is cylindrical in shape, 2.47 cm. in outer diameter, and 2.87 cm. high parallel to the axis. The wall thickness of the upper portion of the housing is 0.15 cm. to a depth 0.84 cm. below the top of 304*d*. The lower end of the accumulator housing 304 is cut back to a wall thickness of 0.13 cm., forming an indentation except for an inwardly directed ring 304*h* centered 0.66 cm. above the lower end.

The lower section of movable piston 312, below the central flange 312*c* is substantially similar in form to 212*b* of FIG. 6B, and rides in vertical reciprocating relation in the central tubular chamber 305*d*. 312*c* which corresponds to flange 12*c* in the embodiment of FIG. 2B, is 2.18 cm. in diameter and 0.015 cm. thick, terminating at its outer periphery in an upwardly-directed cylindrical skirt 312*e* which extends 0.94 cm. from the face of 312*c*. The latter has a wall thickness of 0.13 cm. at the bottom, to a vertical height of about 0.38 cm., from which it is tapered to a thickness of about 0.03 cm. at the upper end.

Cylindrical skirt 312*e* moves vertically in reciprocal fashion inside of the cylindrical housing 304*x*, making contact with the inner wall at its tapered upper end, just above the top of the indentation, at the lower end of 304*x*.

On the left-hand inner side of accumulator housing 304*x*, extending about 0.13 cm. above the upper end of the indentation of 304*x*, is a groove 304*s* about 0.13 cm. wide and 0.02 cm. deep, which is disposed to provide an opening with the top of skirt 312*e*, about 0.02 cm. high, when 312*e* is in rest position against the inner ring 304*h*, thus permitting air to come into the chamber 304*g*. When piston 312 moves up vertically against the compression of coil spring 314, the opening formed by groove 304*s* is sealed.

The upper axial tube 312*a* of the movable piston 312 is 0.52 cm. in outer diameter and 0.30 cm. in inner diameter, and extends 0.94 cm. above the face of 312*c*. The cylindrical wall is 0.10 cm. wide at the bottom, the upper 0.51 cm. being tapered to a width 0.03 cm. at the top.

As in the previously described embodiments, the axially-disposed check valve 310, which includes the vertically-extending valve-stem 320, is designed to seat in a valve opening centered in 312*c*.

The accumulator tube 304*c* is integral with and axially disposed in the housing 304, being 0.81 cm. in outer diameter and 0.52 cm. in inner diameter, its lower end extending 1.05 cm. below the lower face of the annular partition 304*d*. The wall thickness of the lower end of accumulator tube 304*c* is 0.13 cm., except for the bottom, which is tapered to a thickness of 0.09 cm. and rounded.

The upper end of tubular accumulator 304 is of substantially different form than those disclosed in the embodiments of FIGS. 2B and 6B. The annular inner chamber 304*g*, which is 0.81 cm. in diameter, extends 0.72 cm. along the axis from its tapered, open lower end to its partially closed upper end, which projects 1.05 cm. above the upper surface of annular partition 304*d*. The upper wall of 304*c* is bifurcated to form a V-shaped cross-section at the top. The outer arm of the V extends vertically 1.82 cm. flush with the outer wall of 304*c*, forming an annular flexible flange 304*n* extending 0.33 cm. up from the apex of the V. The flange 304*n* is about 0.04 cm. thick at its base and is tapered to a thickness of 0.02 cm. at the top.

The annular inner arm of the V forms a frustum of a cone, having an inner diameter 0.41 cm. at the base which is tapered to 0.12 cm. in diameter at the upper end, forming a cylindrical opening 304*f* about 0.12 cm. along the axis. The walls of the cone have an overall thickness of 0.13 cm.

The cylindrical nozzle housing 324 snap-fits onto the annular ring 304*i* projecting up from the upper end of accumulator housing 304. Nozzle housing 324 is 1.98 cm. in outer diameter of its outer shell 324*a* which has a wall thickness of 0.13 cm., and which accommodates a nozzle, including swirl chamber housing 311, disposed to project spray out in a lateral direction.

Housing 324 includes an annular closure 324*f* at its upper end, having an overall thickness of 0.14 cm., which is integrally formed to include an inwardly directed tube 324*b*, 1.07 cm. in outer diameter and 0.81 cm. in inner diameter, the lower end of which extends down vertically 1.08 cm. from the top and is seated in a recess at the top of partition 304*d*. Thus, the tube 324 accommodates the upper end of accumulator tube 304*c*, so that the flexible flange 304*n* seats against the inner wall of 324. On the left-hand side, the inner wall of 324 has a groove 324*x*, which is about 0.03 cm. in the plane of the drawing and 0.06 cm. wide, and extends 0.56 cm. to its lower end where it connects into an opening about 0.13 cm. wide in 304*d* leading into the air chamber 304*g*.

As in the embodiment of FIG. 6B, a deflectable diaphram 330 is centered in the top 324*f*, and rests against the top of opening 304*f* in the frustoconical upper end of accumulator tube 304*c* with a pressure of about 2.1 kilograms per square centimeter (30 pounds per square inch).

The annular mixing chamber 324*g* between the frustoconical top of accumulator 304*c* and diaphram 330 opens through 324*e* into the swirl chamber 311, which is substantially similar in form and function to the swirl chamber and nozzle arrangement described in detail with reference to FIG. 6B.

This embodiment is operated as follows. When the trigger arm 306*a* is depressed on the first stroke, lever arms 306*c* and 306*d* (not shown) engage the underside of 312*c*, raising the movable piston 312 against the compression of spring 314, closing 304*s* and compressing the air in the outer chamber 304*g*. The compressed air passes up through groove 324*x* and deflects the flexible annular flange 304*n*, passing into mixing chamber 324*g*. If there is any liquid product in accumulator tube 304*c*, it is forced up through opening 304*f* against the pressure of diaphram 330, also passing into mixing chamber 304*g*, where it mixes with the compressed air from the air chamber. The mixture of high pressure air and product is forced through the opening 324*e* and into the arms of swirl chamber housing 311, finally being emitted as a blast of spray through the opening 311*c*.

When the spring 314 returns to its normal position, a partial vacuum is created in air chamber 304*g*, causing air to rush in through the now open groove 304*s*. Also, the pressure of product coming up from the container through dip-tube 307 forces valve 310 off of its seat in flange 312*c*, and product liquid is forced into the accumulator tube 304. The process is then repeated on the next trigger stroke.

It will be seen that this embodiment, which is designed to mix viscous product with air at ratios of, say, 10 to 30 parts of air to one of product, creates a high pressure, mixture of air and product. This creates a fine break-up of the high viscosity product, or any other type product, which emerges in a dry spray.

Figure 9A:
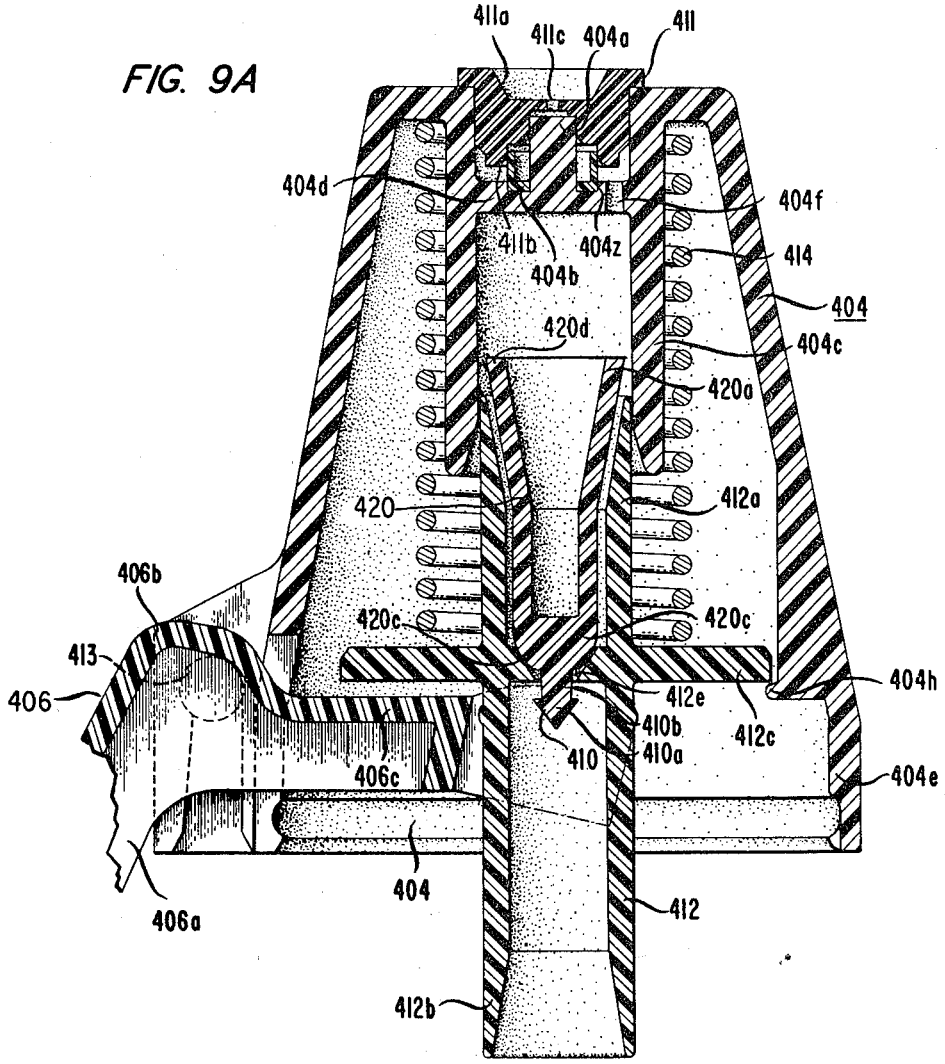
FIG. 9A shows an enlarged vertical section through the diameter, of the upper portion vertical trigger sprayer, in the non-engaged position, specially modified to include a conical-shaped check valve stem and the force-fitted flexible-flange.

A further embodiment of the invention is shown in FIG. 9A of the drawings which is specially adapted to breakup a high viscosity product.

As in the previous embodiments shown and described with reference to FIGS. 2A and 2B, the upper screw cap 405, the lower end 412*b* of the piston 412, the trigger mechanism 406 and also the spray mechanism 411, are substantially similar to the structures there shown and described, and therefore need not be completely depicted in FIGS. 9A and 9B. The device may be formed of the same or similar plastic materials as the embodiments previously described. For simplification of the description with reference to FIGS. 9A and 9B, 400 will be added to the reference characters of elements similar to those of FIGS. 2A and 2B. Elements bearing corresponding numbers are substantially similar, unless otherwise stated.

The main modification in this embodiment is the structural shape of the valve stem 420, which may be used as an alternative to the cruciform valve stem 20 in FIG. 2B. The valve-stem 420 is mounted in a coaxial relation to the center axis, and is in the general shape of an invented frustum of a cone. At its base, the cone is 0.58 cm. in diameter and extends down 0.63 cm. along the center axis where the cone is truncated; at this point the frustum has a diameter of 0.35 cm. The valve stem 420 then extends down along the center axis in a cylindrical fashion to an overall length of 1.27 cm. The lower portion 420*c* of the valve-stem 420 which is designed to contact valve-seat 412*e*, is tapered from 0.32 cm. to 0.20 cm. in diameter. Disposed on the lower end of valve stem 420 is valve head 410. The upper end 410*b* of valve head 410 is slightly tapered to have decreasing diameter between its upper and lower ends, having an overall length of 0.17 cm. This terminates on the lower end in a cone 410*a* of elliptical cross-section extending downward to an apex.

Figure 9B:
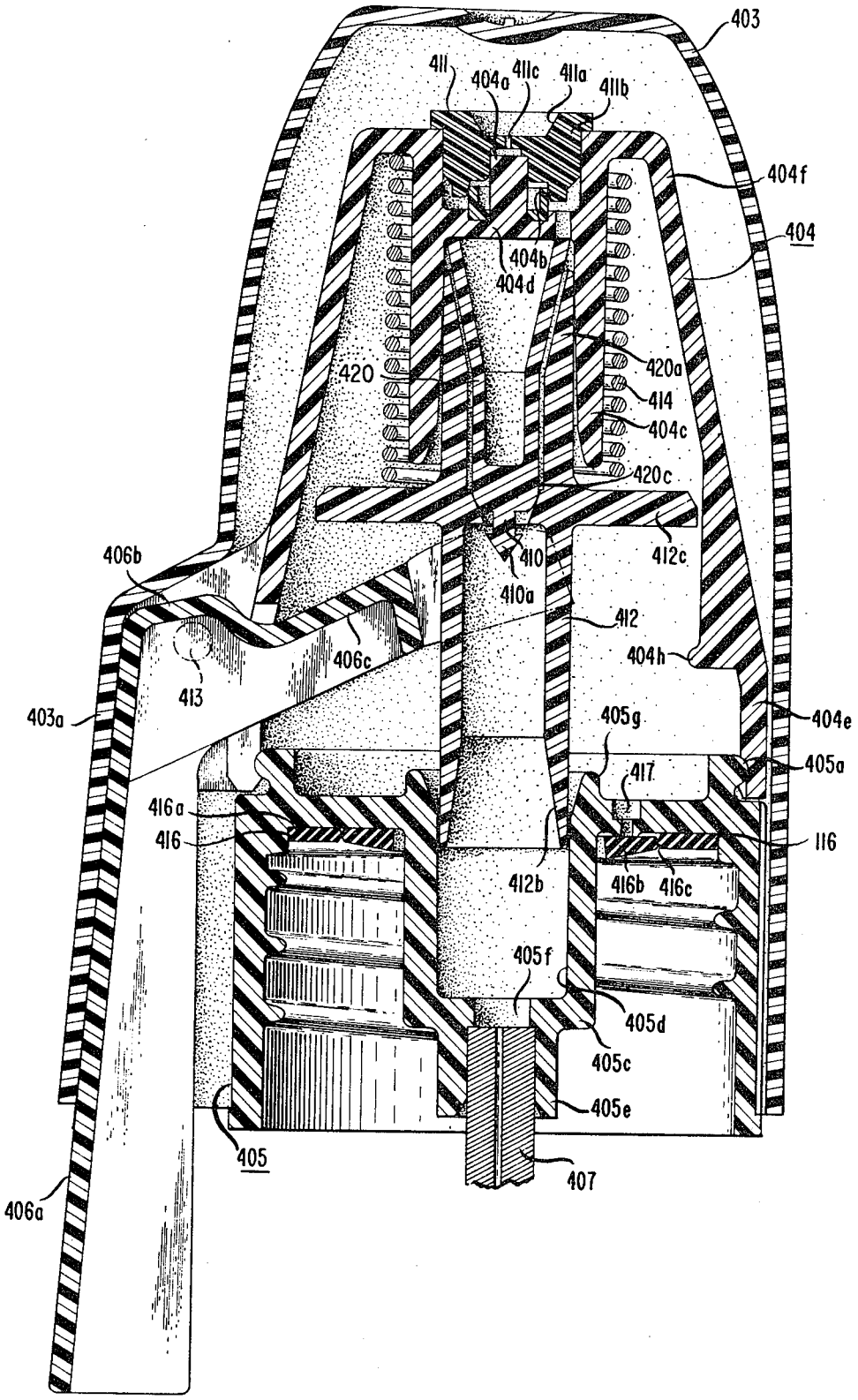
FIG. 9B shows the identical section of FIG. 9A, except that the sprayer is shown in the engaged shipping position with the enclosing cap in place.

A second modification in FIGS. 9A and 9B relative to FIG. 2B is in the upwardly directed annular flexible flange 404*b* attached to the upper surface of partition 404*d*. In the present embodiment, flange 404*b* is a separate inserted member which is force-fitted into the appropriate circular groove 404*z* in the upper surface of partition 404*d*, which combination is described in further detail with reference to FIG. 11 hereinafter.

In a preferred embodiment, flange 404*b* is formed from different material than that of the upper accumulator housing. For example, a more flexible material, may be used such as, low density polyethylene, which has a modulus of elasticity in flexure of, say, not exceeding about $21.0\times10^5$ grams per square cm., whereas the accumulator housing 404, in the present example, has a modulus of elasticity of flexure of, say, not less than at least about $70\times10^5$ grams per square cm. Thus, this gives flange 404*b* a flexibility of at least about 3 times that of the material of accumulator housing 404. This allows for use of a product of higher viscosity due to the greater flexibility of the flexible flange.

FIG. 9B is an identical view to that of FIG. 9A, except that the present drawing also shows cap 403 placed over the accumulator housing 404, which is the position of the embodiment when stored or shipped.

Cap 403 is of general hollow cylindrical shape, closed at the upper end, which has a diameter of 0.55 cm. The cap 403 extends from top to bottom, having a bulge 403*a* in one side to accommodate the trigger 406, and hold it down in a shipping position. The overall outer diameter of the cap 403 is 3.30 cm. with a uniform wall thickness of 0.05 cm.

When cap 403 is placed over the accumulator housing 404 it depresses trigger 406. This, in turn, raises piston 412 and check-valve 420 and holds it in place against the compression of the spring 414. The top edge 420*d* of the check valve 420 is forced against the inner top accumulator partition 404*d*; and simultaneously, the bottom, tapered edge 420*c* of the check-valve head 420 seats against the valve seat 412*e*, at the center of the piston 412. When in this position, the product is prevented from flowing from the lower chamber (not shown) into the upper accumulator chamber 404*c*.

A particular feature of this embodiment is that when it is in the shipping position and the cap 403 is on, any product in the upper accumulator chamber 404*c* has been dispensed by the valve-stem 420 being forced against the bottom of the inner top accumulator wall 404*d*. Simultaneously, the bottom edge 420*c* of valve-stem 420 is seated against the valve seat 412*e* of piston 412, thereby making a "positive seal," preventing any product from dispensing when the cap is in place.

A further embodiment of the invention shown in FIGS. 10A, 10B, 10C and 10D of the drawings is specially adapted to break-up a high viscosity product.

As in the previous embodiments, shown and described with reference to FIGS. 6A and 6B and FIGS. 8A and 8B, the lower portions of the sprayer of FIG. 10B, including the screw cap 505, the lower end 512*b* of piston 512, and trigger mechanism 506 are substantially similar to the structures shown in FIG. 2B. The device may be formed of the same or similar plastic materials as the embodiments previously described. For simplification of description with reference to FIGS. 10A, 10B, 10C and 10D, 200 will be added to the reference characters of elements similar to those of FIGS. 8A and 8B. Elements bearing corresponding numbers are substantially similar, unless otherwise stated. Any differences as to form and/or function of the elements will be pointed out as this description proceeds.

In the embodiment under description, the accumulator housing 504 is modified so as to eliminate the diaphragm 330 in FIG. 8B. Also eliminated in this embodiment is the inverted frustoconical member having opening 304*f* on which the diaphragm 330 rests, as shown in FIG. 8B.

The accumulator 504 comprising a stationary tube 504*c* has an overall diameter of 1.44 cm., a wall thickness of 0.15 cm. and extends 2.19 cm. from top-to-bottom in an axial direction. The wall of the tube comprising accumulator 504*c* is tapered, beginning 0.17 cm. above its lower end, to a wall thickness of 0.10 cm. at the bottom. The top of the accumulator 524*t* extends beyond the left-hand wall 504*c* of the accumulator 504 to an overall diameter of 1.94 cm., to accommodate a chamber for the laterally directed spray button which will be described presently.

Located 0.8 cm. below the top 524*t* is a shoulder 504*n* which extends outwardly 0.51 cm. along a plane perpendicular to wall 504*c*. The shoulder 504*n* is perpendicular to a stationary tubular skirt 504*x* which has an overall diameter of 2.46 cm. The walls of the skirt 504*x* extend downward from shoulder 504*n* to an overall length of 3.3 cm.

The internal upper portion 504*d* on the left-hand side of accumulator wall 504*c* forms the partition of the laterally directed spray button chamber. Partition 504*d* is grooved to form an annular groove or recess 504*z* which is in coaxial relation to cylindrical plug 524*a*, in a similar manner to the inner accumulator partition 404*d* in FIG. 9A. Force-fitted into the annular groove 504*z* is an annular flexible flange 504*b*. This flange is identical in purpose, structure and design to flange 404*b* in FIG. 9A.

At a position 0.69 cm. below the annular groove 504*z* is a circular opening 504*f* which is 0.07 cm. in diameter. Upon the depression of trigger 506, the product is forced up through the circular opening 504*f* from the inner chamber of the accumulator 504*c* into the outer annular chamber 524*g*.

Figure 10A:
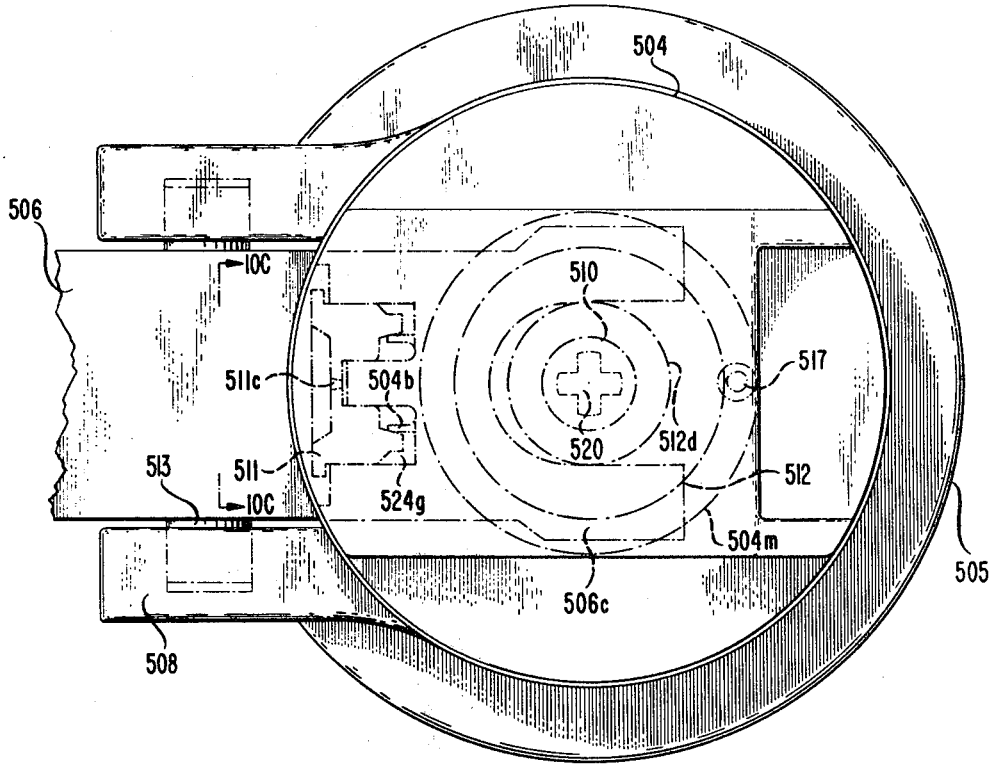
FIGS. 10A and 10B show, respectively, an enlarged plan view and vertical section through the diameter, a horizontal trigger sprayer, specially modified to eliminate the diaphragm and include a force-fitted flexible-flange.
Figure 10C:
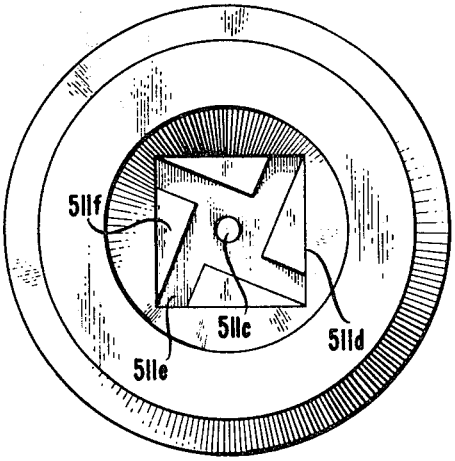
FIG. 10C shows an enlarged vertical cross-section looking into the spray button of FIG. 10A.
Figure 10B:
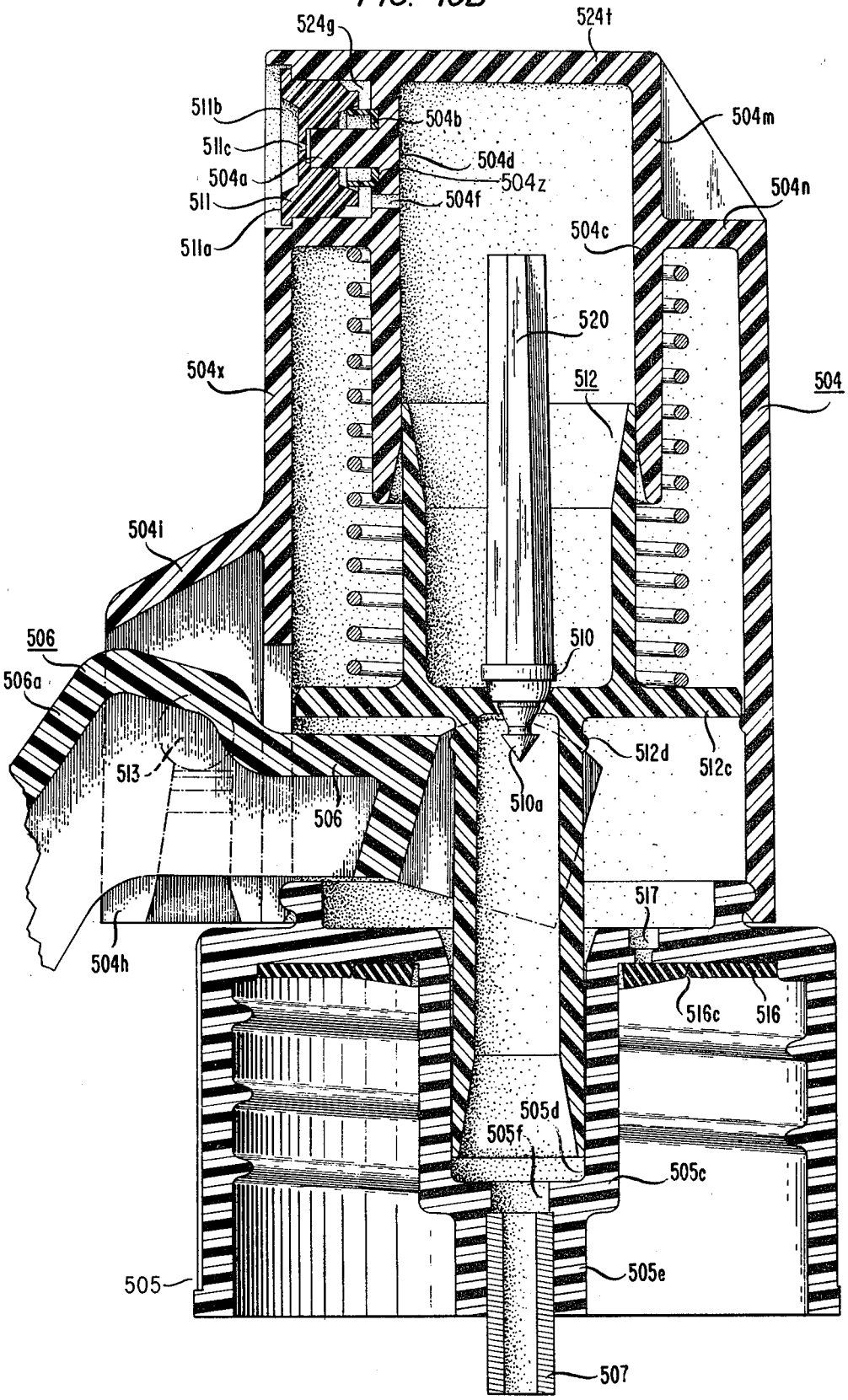
Figure 10D:
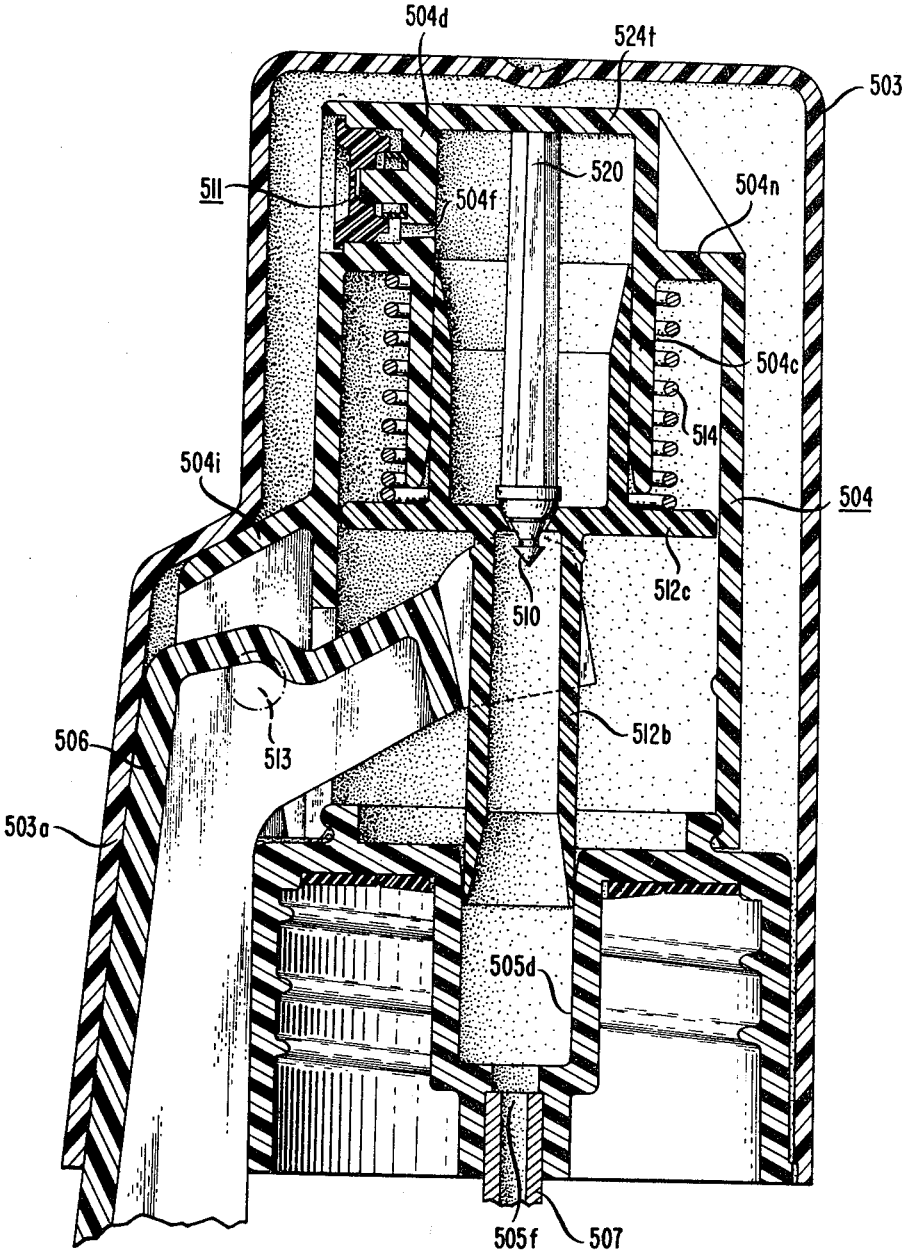
FIG. 10D shows the identical section of FIG. 10B, except that the sprayer is shown in the engaged shipping position with the enclosing cap in place.

FIG. 10D is the identical view to that of FIG. 10B, except that the present drawing also shows cap 503 placed over the accumulator housing 504, which is the position of the embodiment when stored or shipped. Cap 503 is of general hollow cylindrical shape, closed at the upper end, which has a diameter of 3.20 cm. The cap 503 extends from top-to-bottom, having a bulge 503*a* in one side to accommodate the trigger 506, and hold it down in a shipping position. The overall outer diameter of cap 503 is 4.40 cm. with a uniform wall thickness of 0.10 cm. Cap 503 in FIG. 10D operates in a substantially similar manner and has similar features as that of cap 403 in FIG. 9B.

Figure 11:
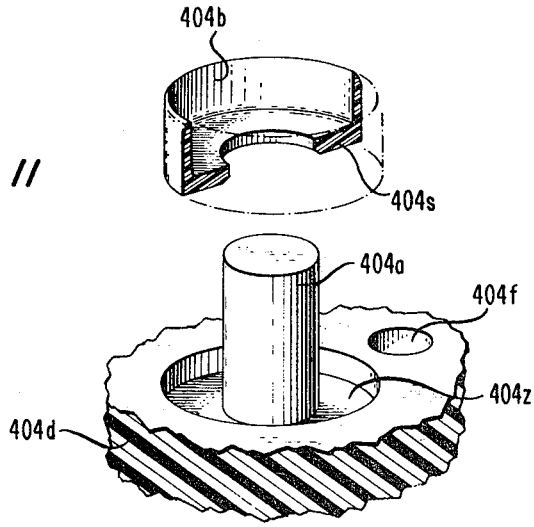
FIG. 11 shows an exploded view of the annular flange specially constructed to have a greater flexability than previously described valves, and the cylindrical plug and attached accumulator wall, specially modified to have an annular groove in which the flexible-flange may be force-fitted. (See FIGS. 9A et seq.)

FIG. 11 is an exploded view of the annular flexible flange of different material from the accumulator housing and designed to be separately inserted. This element is denoted as 404*b* and 504*b* in FIGS. 9A and 9B and FIGS. 10A and 10B, respectively. Also shown are the cylindrical plug and partition, which have been previously described as 404*a*, 404*d*, and 504*a*, 504*d* in FIGS. 9A, 9B and FIGS. 10A, 10B, respectively.

As applied to FIG. 9A, this assemblage comprises an annular base 404S which has an outer diameter of 0.36 cm. and an inner diameter of 0.19 cm., and a uniform wall thickness of 0.04 cm. Extending normally 0.15 cm. from the outer edge of the annular base 404S is the cylindrical flange 404*b*. The latter has a uniform thickness of 0.02 cm., and is tapered at its upper end. Thus, the flange 404*b* extends 0.11 cm. above the upper edge of the annular base 404S. As previously described, the annular flexible flange 404*b* is constructed of a lower density material, such as polyetheylene which has a modulus of elasticity in flexure of, say, not exceeding about $21.0\times10^5$ grams per square cm.; whereas the accumulator housing described with reference to the previous figures, and hereinafter described, has a modulus of elasticity in flexure of, say, not less than at least about $70.0\times10^5$ grams per square cm., thus giving flange 404*b* a flexability of at least about three times of the material of the accumulator housing of previously described figures, so as to allow for use of a more viscous product to pass into the swirl chamber and out through the dispensing nozzle.

Flange 404*b* seals tangentially against the inner periphery of skirt 411*b* shown in FIG. 9A. This tangential seal keeps air out, preventing excess product from crystallizing and allows the container (corresponding to 2, as shown and described in previous figures) to maintain a vacuum.

Cylindrical plug 404*a* attached to the upper surface of partition 404*d*, is surrounded with an annular groove 404*z* dimensioned to just accommodate the flange 404*b* in a force fit. Plug 404*a* and partition 404*d* may be formed of the same high density material, say polypropylene, as the accumulator housing described in previous figures.

Although the assemblage of flexible flange 404*b* has been described with reference to FIGS. 9A, 9B, it will be understood that the structure of flange 504*b* of FIGS. 10A, 10B is substantially similar; and that the assemblage described can be used to replace similar flexible flanges of the embodiments previously described.

Figure 12:
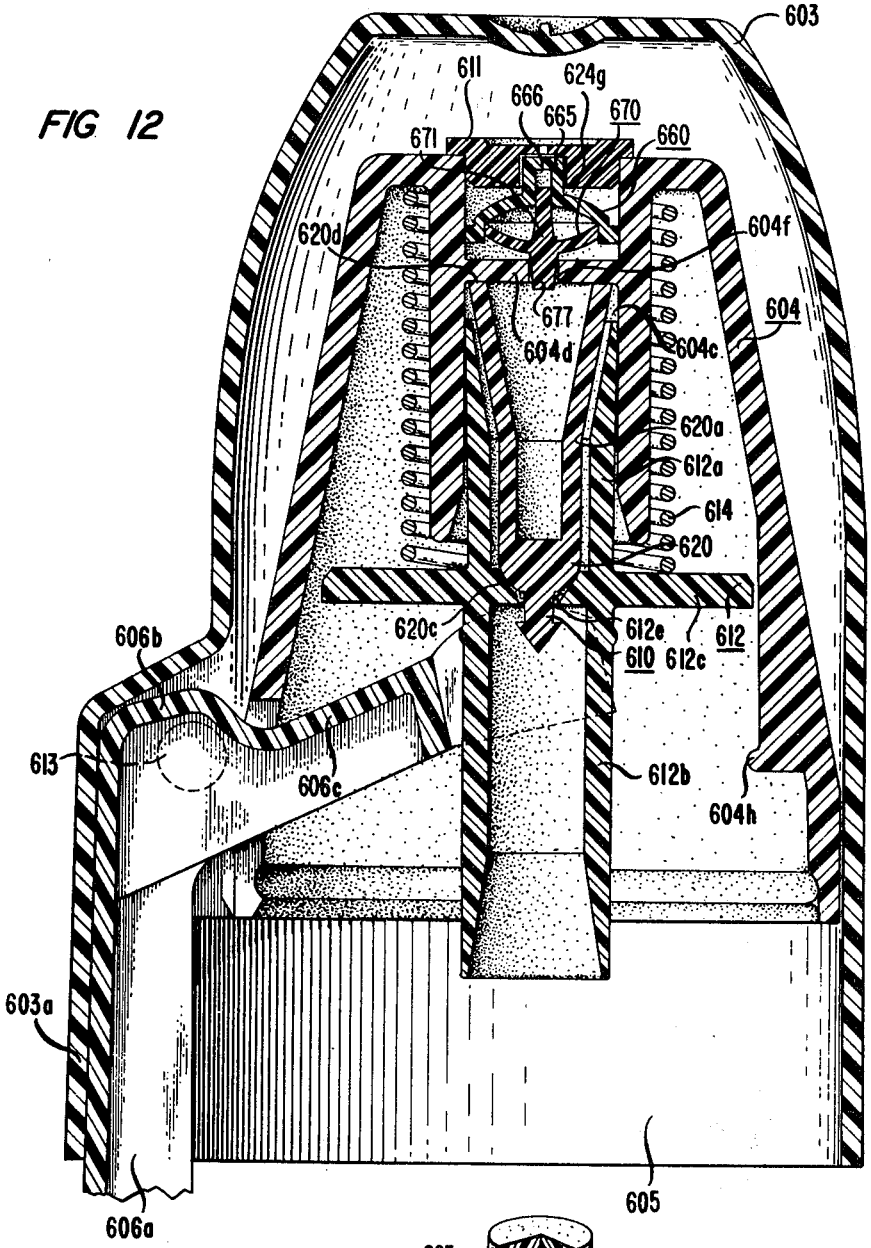
FIG. 12 shows an enlarged vertical section through the diameter of the upper portion of the vertical trigger sprayer, specially modified to include a pressure-responsive diaphragmatic structure which replaces the annular flexible-flange in previous embodiments.
Figure 13:
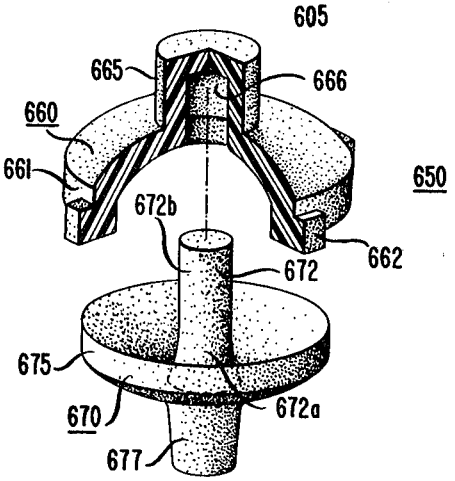
FIG. 13 shows an exploded view of the diaphragmatic structure used as an alternative to the annular flexible-flange.

FIG. 12 shows an identical view of the vertical trigger sprayers to the embodiment described in FIG. 9B except for the modification in the spray button, flexible flange and accumulator partition which will be further described hereinafter. FIG. 13 shows an exploded view of the same modification. For simplification of description with reference to FIGS. 12 and 13, two hundred will be added to the reference numbers of elements similar to those of FIGS. 9A and 9B. Elements bearing corresponding numbers are substantially similar, unless otherwise stated.

The principal modification in the present embodiment is the elimination of flange 404*b* and cylindrical plug 404*a*, and substitution of a dome and stopper structure 650. The latter is composed of two components: the dome 660 and the circular stopper 670.

The dome 660 has a circular base with a diameter of 0.55 cm. and a maximum height of 0.20 cm. measured from the base of the dome. The dome 660 has a uniform wall thickness of 0.05 cm. Atop the dome 660 is a hollow cylindrical plug 665. The latter has a diameter of 1.80 cms. and a height of 1.50 cms. Dome 660 has a cylindrical side wall 661 which is 0.10 cm. high. Located at four separate places symmetrically situated around side wall 661 are ribs 662. The latter are 0.08 cm. high, and serve to prevent excessive movement of the dome 660 within spray button chamber 640, yet allowing the fluid product to pass to mixing chamber 624*g*.

Dome 660, particularly plug 665, is lodged in an internal recess of the spray button 611, which is similar to spray button 411 in FIGS. 9A and 9B, except that the skirt of button 611 has been truncated, as the additional length is no longer required now that the flexible flange, described in FIGS. 9A and 9B, has been eliminated.

Sitting inside dome 660 is stopper 670, which comprises a dual headed plug 671 and a skirt 675.

The upper head 671*b* of plug 671 is cylindrical in shape and has a height of 0.24 cm. The base of the upper head 671*b* is 0.11 cm. and tapers to a diameter of 0.06.

The lower head 671*a* of stopper 670 is in the shape of a frustum of an inverted cone. The diameter of the base of lower head 671*a* is 0.13 cm., and extends downward for 0.15 cm., at which point the truncated cone has a diameter of 0.07 cm.

Separating the upper head 671*b* from the lower head 671*a* of stopper 670, is the skirt 675. The latter is of the general shape of a parabolic dish. Skirt 675 has a wall thickness of 0.04 cm. and extends to a diameter of 0.45 cm., which equals the internal diameter of the dome 660, so that the skirt 675 fits snugly into the dome 660. Stopper 670, particularly lower head 671*a*, is lodged in opening 604*f*, which is centrally located on the accumulator partition 604*d*.

When trigger 606 is depressed, the pressure exerted in accumulation chamber 504*c* will cause stopper 670 to rise out of the opening 604*f*. This will flex the skirt, which is constructed of low density polypropylene for greater flexibility. The fluid-product will then flow from the accumulator chamber 604*c* into the mixing chamber 624*g*.

The upper head 672 of stopper 670 is constructed and arranged to seat against the top of the inner well 666 of plug 665. This will prevent any further rise in stopper 670, and will thereby prevent parabolic skirt 675 from inverting.

The lower head 671*a* of stopper 670 seals tangentially against the circular opening 624*g*. This tangential seal keeps air out, preventing excess product from crystallizing and allowing the container (corresponding to 2 as shown and described in previous figures) to maintain a vacuum. Also, the dome and stopper structure 650 will cause the sprayer to emit a constant spray pressure, regardless of the pressure exerted on the trigger 606.

Figure 14:
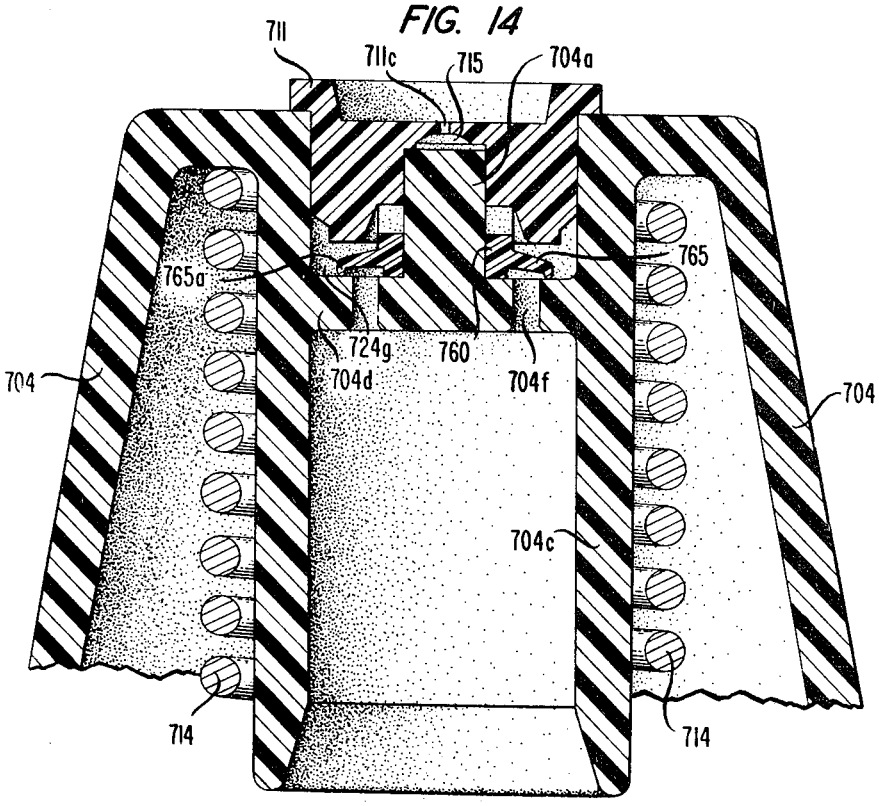
FIG. 14 shows an enlarged vertical section through the diameter, of the upper portion of the vertical trigger sprayer, specially modified to include a pressure-control-valve, replacing the flexible-flange in previous embodiments.
Figure 15:
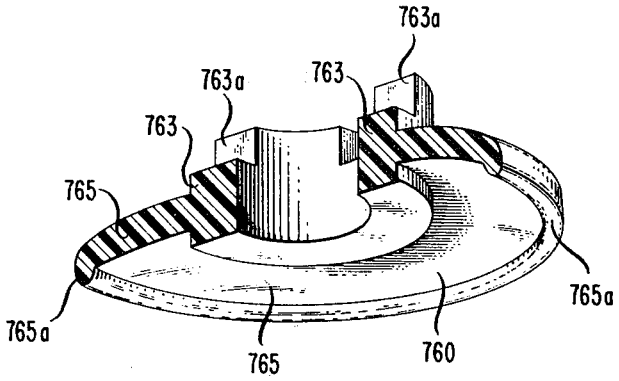
FIG. 15 shows a perspective view partially in section of the pressure-control-valve of FIG. 14.

FIGS. 14 and 15 show a further modification of the flexible flange used in both the horizontal and vertical sprayers. FIG. 14 shows a fragmental vertical section of the upper portion of the vertical sprayer; but it is contemplated that the present modification is adaptable for the horizontal sprayer, as is the modification shown in FIGS. 12 and 13.

FIG. 15 shows a detailed perspective view partially in section, of the flexible flange under description. For simplification of description with reference to FIGS. 14 and 15, three hundred will be added to the reference numbers of elements similar to those of FIG. 9A. Elements bearing corresponding numbers are substantially similar, unless otherwise stated.

The principal modification in the present embodiment is that the flexible flange consists of a pressure control valve 760 which is force-fitted around a cylindrical plug 704*a* which is axially-disposed concentric with the inwardly-directed flange 704*d* near the top of accumulator wall 704*c*. Referring to FIG. 15, pressure control valve 760 has a cylindrical collar 763 having an outside diameter of 0.32 cm., an inside diameter of 0.18 cm. and a height of 0.12 cm. Symmetrically disposed at the upper edge of cylindrical collar 763 are four rectangular notches 763*a* which are 0.06 cm. wide and 0.05 cm. deep. Notches 763*a* permit fluid product to pass from mixing chamber 724*g* to swirl chamber 715. Extending 0.11 cm. out from cylindrical collar 763 located 0.02 cm. above its lower edge, adjacent the upper face of inwardly-directed accumulator flange 704*d*, is an annular flap 765. This curves downward convexly, in the form of a diaphragm, so that its outer edge 765*a* assumes the form of a downwardly-directed ring contacting the top face of inwardly-directed accumulator flange 704*d*, tangentially. Except for the downwardly-directed ring 765*a*, on its periphery, flap 765 increases in wall thickness from 0.02 cm. at its outer portion to 0.03 cm. where it contacts collar 763.

Inwardly-directed accumulator flange 704*d* is modified to include four symmetrically disposed openings 704*f*, each having a diameter of 0.06 cm., and located 0.16 cm. from the center of cylindrical plug 704*a*.

An additional modification in the present embodiment is a dome-shaped chamber 715 in spray button 711 which increases the capacity of this chamber over those disclosed in previous embodiments and allows the fluid product to achieve a higher velocity which permits a finer, wider spray pattern. Dome-shaped chamber 715 is 0.13 cm. wide and 0.03 cm. high at its zenith, and is centered on the lower end of spray opening 711*c*.

When trigger 706 (not shown) is depressed, the pressure exerted in the accumulator chamber 704*c* will cause flap 765 of pressure control valve 760, to flex upwardly, allowing the fluid product to flow from accumulator chamber 704*c* into mixing chamber 724*g*. As in previous embodiments, pressure control valve 760 may be constructed of low-density polypropylene so that it may exhibit the same flexing properties as the flanges previously described.

Pressure control valve 760 has the same features and advantages as previous flanges, but in a one piece configuration. In addition, flap 765 acts as a one-way flap, sealing against the face of the inwardly-directed accumulator flange 704*d*, preventing fluid-product from flowing back into the accumulator chamber 704*c*. Also, greater flexibility is achieved in the flap of the present embodiment, in that it flexes upwardly, as opposed to flange 404*b* of FIG. 9A, which flexes inwardly. This upward flexure provides for a more uniform amount of spray to be expelled with each depression of trigger 706, and also provides instant "cut off" upon release of trigger 706.

FIGS. 16 and 17 show a further modification of the horizontal trigger sprayer of the present invention. The lower portion of the present embodiment is similar to that of the vertical sprayer, previously described with reference to FIG. 9A, the principal modification in the present embodiment being a horizontally-directed, semi-dome-shaped upper end 800. For simplification of description with reference to FIGS. 16 and 17, 400 will be added to the reference numbers of elements similar to those of FIG. 9A. Elements bearing corresponding numbers are substantially similar, unless otherwise stated.

Tubular accumulator 804*c*, having an inside diameter of 0.59 centimeters, is modified to include a roughly frusco-conical upper portion 804*p* which extends the height of accumulator 804*c* an additional 0.76 centimeters above annular partition 804*n*. The latter, which partitions off the conical upper portion 804*p*, has an inside diameter of 0.45 centimeters. Thereafter conical upper portion 804*p*, extends upward with decreasing diameter, so that at the upper end thereof has a diameter of 0.24 centimeters. Closing the upper end of conical portion 804*p* is accumulator-top 824*t*, which is semi-dome-shaped in the present embodiment. However, it will be understood that accumulator-top 824*t* may be formed of any desired shape, and is not limited to the shape disclosed herein. Accumulator-top 824*t* extends 0.44 centimeters beyond the left-hand wall of accumulator 804*c*, to accommodate a chamber for the laterally-directed spray button 811.

The upper portion of accumulator wall 804*c*, *adjacent spray button 811, forms the partition 804d* of the laterally-directed spray button chamber. Partition 804*d* is similar to partition 404*d* of FIG. 9A and has similar openings 804*f*, allowing product to enter into mixing chamber 824*g*. The operation of spray button 811, including cylindrical plug 804*a*, is similar in form to those previously described; and the present embodiment may employ all of the modifications of annular flexible flanges described with reference to the previous embodiments.

The modification of the shape of the upper end of accumulator 804*c* alows product to be dispensed in approximately a horizontal direction.

FIG. 18 shows a horizontally-directed spray member 900 in a position rotated 90° from its conventional upright position which is designed to be attached to the top of the vertical sprayer of the present invention, such as shown and described with reference to FIG. 9A. Spray member 900 is inserted into the top of accumulator 404, when spray button 411 is removed, converting the vertical sprayer into a horizontal trigger sprayer.

The vertical sprayer of FIG. 9A, with horizontal spray member 900 appropriately inserted, is substantially similar to the horizontal trigger sprayer shown and described with reference to FIGS. 16 and 17. For simplification of description with reference to FIG. 18, 100 will be added to the reference numbers of elements similar to those of FIGS. 16 and 17. Elements bearing corresponding numbers are substantially similar unless otherwise stated.

The principal modification of spray member 900 over the horizontally-directed upper member 800 of FIGS. 16 and 17 is the addition at its lower end of an annular cylindrical flange 904*h* which extends down 0.50 centimeters from shoulder 904*n*. The latter seats on top of the upper surface of accumulator 404 of FIG. 9A. Flange 904*h* which has an inside diameter of 0.50 centimeters and an outside diameter of 0.72 centimeters, has a dual function. First flange 904*h* serves as the lower portion of the upper conical extension 904*p* of stationary tube 404*c*. (See FIG. 9A.) In addition flange 904*h* acts as the keying or inverted member, securing spray member 900 to the upper end of accumulator 404.

As flange 904*h* has parallel side walls, designed to be in a vertical position, indentation 909, which projects inwardly just below shoulder 904*n*, is not as pronounced as the similar indentation made by annular partition 804*n* shown in FIG. 17.

With horizontal spray member 900 inverted in the top of the vertical trigger sprayer, the present embodiment will be substantially similar in function and design to the embodiment as shown and described with reference to FIGS. 16 and 17.

For purposes of illustration, the invention has been described with reference to the specific embodiments shown in the drawings. However, it will be understood that the invention is not to be construed as limited to the specific forms or dimensions given herein by way of example, but only by the scope of the appended claims.

What is claimed is:

1. A manually operated spray dispenser constructed in combination with the closure of a container of fluid product having an upwardly extending mouth, said dispenser comprising in combination:

an accumulator housing forming in fixed relation to said closure an outer tubular wall constructed to extend upwardly from the mouth of said container, said accumulator housing enclosing in integral coaxial relation an upper stationary tubular accumulator, and the mouth of said container enclosing in integral coaxial relation a lower stationary tubular member vertically spaced apart from said upper tubular accumulator;

means for communicating between said lower stationary tubular member and the fluid in said container;

a spray dispensing nozzle mounted in said accumulator housing in a spray button chamber in communication with said upper stationary tubular accumulator member;

a hollow tubular piston having its upper and lower ends respectively disposed to move in vertically reciprocating relation in said upper stationary tubular accumulator and said lower stationary tubular member;

an annular lateral enlargement connected to said hollow tubular piston intermediate between the upper and lower ends thereof, said annular lateral enlargement having an upper face and an underside;

means comprising a check valve located in said hollow tubular piston intermediate between the upper and lower ends of said piston and responsive to a pressure differential between said ends to admit said fluid product from the lower end into the upper end of said hollow tubular piston;

a helical coil-spring surrounding said upper stationary tubular accumulator and compressed between a fixed upper wall of said accumulator housing and the upper face of said annular lateral enlargement;

a pivot mounted in horizontal relation to the outer tubular wall of said accumulator housing;

trigger means mounted to rotate in a vertical plane about said pivot, said trigger means including a downwardly extended trigger arm, and horizontally extended lever means disposed to contact the underside of said annular enlargement and to move said hollow tubular piston vertically against the compression of said coil spring; and means for maintaining said container at substantially ambient pressure.

2. The combination in accordance with claim 1 wherein said means for communicating between said lower stationary tubular member and the fluid in said container comprises a dip-tube.

3. The combination in accordance with claim 1 in which said fluid product is liquid.

4. The combination in accordance with claim 1 in which said product comprises particulate matter suspended in a carrier.

5. The combination in accordance with claim 1 comprising sealing means between said upper stationary tubular accumulator and said nozzle, said sealing means normally closed to air passing in through said nozzle but responsive to the pressure of product fluid passing up from said upper stationary tubular accumulator to open and release said sealing means to permit the passage of said fluid product out through said nozzle.

6. The combination in accordance with claim 1 wherein the force-multiplying ratio between said downward extending trigger arm and said horizontally extended lever means in relation to said pivot at least exceeds 2.

7. The combination in accordance with claim 1 wherein an insert including a swirl chamber is mounted immediately adjacent said spray dispensing nozzle.

8. The combination in accordance with claim 7 wherein a spray nozzle housing including a communicating chamber is formed between an upper end of said accumulator housing said spray dispensing nozzle, said spray nozzle housing having a cylindrical recess;

a cylindrical plug projecting from said communicating chamber in axial relation to the cylindrical recess of said nozzle housing;

the insert including said swirl chamber adjacent said dispensing nozzle having a skirt of resilient material with a cylindrical periphery which fits slideably into said recess and which has an inner cavity of square cross section which surrounds said cylindrical plug and is contiguous with said plug at its four corners, thereby providing recesses between said inner cavity of square cross-section and said cylindrical plug through which product is forced from said communicating chamber into said swirl chamber, and thence through said dispensing nozzle.

9. The combination in accordance with claim 8 wherein the width of the spray pattern of said spray nozzle is a function of the depth to which the skirt of resilient material is pre-set in said cylindrical recess.

10. A vertical spray dispenser in accordance with claim 8 wherein said spray dispensing nozzle is directed vertically upward from the top of said accumulator housing in substantially coaxial relation to said tubular accumulator, and wherein the insert including said swirl chamber includes an annular skirt of resilient material;

said tubular accumulator including at its upper end an annular deflectable flange coaxially disposed to said skirt, and constructed in normally-closed condition to seal in fluid-tight relation against the inner periphery of said skirt, and responsive to deflect inwardly from the inner periphery of said skirt in response to pressure of fluid product derived from said tubular accumulator, thereby to release said fluid product to pass into said swirl chamber and out through said dispensing nozzle.

11. In combination with a vertical sprayer in accordance with claim 10;

a horizontally-directed spray member, including said spray nozzle housing, mounted in substantially a horizontal relation to said spray dispenser, wherein said spray member includes an upper accumulator adjacent said spray nozzle housing in communication with said tubular accumulator;

means including a plurality of openings in said upper accumulator wall for communicating between said upper accumulator and said spray nozzle housing;

an annular flange extending vertically downward from said horizontally-directed spray member, constructed and arranged to be force-fitted into the spray button chamber of said vertical sprayer from which said spray button has been removed.

12. The combination in accordance with claim 10 wherein said annular deflectable flange is in the form of a separable unit comprising an annular base member integrally formed with said deflectable flange, said accumulator housing including at its upper end adjacent the insert including said swirl chamber, a recess surrounded by and disposed in coaxial relation to said annular skirt for receiving said base member in a snug fitting relation, whereby the said annular deflectable flange comprises a material having a substantially greater flexibility than the flexibility of the material comprising said accumulator housing.

13. The combination in accordance with claim 10, wherein said annular flexible flange is made from material which has a flexibility of about three times greater than that of said accumulator housing.

14. A horizontal spray dispenser in accordance with claim 8 wherein said spray dispensing nozzle is mounted in a laterally dispensing position adjacent the top of said accumulator housing, an annular chamber in the top of said accumulator housing including means for communicating between said tubular accumulator and said nozzle, said means including an opening normally closed by a preloaded diaphragm, said diaphragm subject to be forced up by the pressure of fluid from said tubular accumulator to admit said fluid into said annular chamber.

15. A vertical spray dispenser in accordance with claim 8 wherein said spray-dispensing nozzle is directed vertically upward from the top of said accumulator housing in substantially coaxial relation to said tubular accumulator, and wherein the insert including said swirl chamber includes an annular skirt of resilient material;

said tubular accumulator including at its upper end a dome and stopper structure coaxially disposed to said annular skirt;

said dome and stopper structure constructed in a normally-closed condition to seal in a fluid-tight relation against the top of said communicating chamber, and responsive to raise upwardly from the top of said communicating chamber in response to the pressure of fluid product derived from said tubular accumulator, thereby to release said fluid product to pass into said swirl chamber and out through said dispensing nozzle.

16. A horizontal spray dispenser in accordance with claim 8, wherein said spray-dispensing nozzle is mounted in a laterally dispensing position adjacent the top of said accumulator housing and wherein the insert including said swirl chamber includes an annular skirt of resilient material;

said tubular accumulator including at its upper end a dome and stopper structure co-axially disposed to said annular skirt;

said dome and stopper structure constructed in a normally-closed condition to seal in a fluid-tight relation against a lateral wall of said communicating chamber, and responsive to move laterally from the lateral wall of said communicating chamber in response to the pressure of fluid product derived from said tubular accumulator, thereby to release said fluid product to pass into said swirl chamber and out through said dispensing nozzle.

17. A vertical spray dispenser in accordance with claim 8 wherein said spray-dispensing nozzle is directed vertically upward from the top of said accumulator housing in substantially co-axial relation to said tubular accumulator, and wherein the insert, including said swirl chamber, includes an annular skirt of resilient material;

said tubular accumulator, including at its upper end, a pressure control valve comprising a flexible annular flap attached to a hollow cylindrical collar, coaxially disposed to said cylindrical plug;

said pressure control valve constructed in normally closed condition to seal in fluid-tight relation against the top of said communicating chamber, and responsive to the pressure of fluid product derived from said tubular accumulator to release said fluid product to pass into said swirl chamber and out through said dispensing nozzle.

18. A horizontal spray dispenser in accordance with claim 8, wherein said spray-dispensing nozzle is mounted in a lateral dispensing position adjacent the top of said accumulator housing, and wherein the insert, including said swirl chamber, includes an annular skirt of resilient material;

said tubular accumulator including at its upper end, a pressure control valve comprising a flexible annular flap attached to a hollow cylindrical collar, co-axially disposed to said cylindrical plug;

said pressure control valve constructed in normally-closed condition to seal in fluid-tight relation against a lateral wall of a said communicating chamber, and responsive to move laterally from the lateral wall of said communicating chamber in response to the pressure of fluid product derived from said tubular accumulator, thereby to release said fluid product to pass into said swirl chamber and out through said dispensing nozzle.

19. The combination in accordance with claim 8 wherein a constant amount of said product is expelled upon each depression of said trigger.

20. The combination in accordance with claim 19 wherein the amount of said product expelled is a function of, and varies directly with, the volume of said communicating chamber.

21. A spray dispenser in accordance with claim 8, wherein said spray-dispensing nozzle is mounted in a dispensing position adjacent the top of said accumulator housing, and wherein the insert, including said swirl chamber, includes an annular skirt of resilient material;

said tubular accumulator including adjacent its upper end, a pressure control valve comprising a flexible annular flap attached to a hollow cylindrical collar, co-axially disposed to said cylindrical plug;

said pressure control valve constructed in normally-closed condition to seal in fluid-tight relation against a lateral wall of a said communicating chamber, and responsive to move laterally from the lateral wall of said communicating chamber in response to the pressure of fluid product derived from said tubular accumulator, thereby to release said fluid product to pass into said swirl chamber and out through said dispensing nozzle.

22. A spray dispenser in accordance with claim 1 for a mixture of air and liquid product wherein the inner surface of the outer tubular wall of said accumulator housing defines an annular air chamber disposed in coaxial relation to said tubular accumulator;

the annular lateral enlargement of said hollow tubular piston terminating at its outer periphery in an upwardly directed cylindrical skirt which slideably engages said inner surface of said outer tubular wall in air-tight relation for reciprocating motion with respect to said surface for compressing the air in said chamber when said hollow tubular piston moves up against the compression of said coil spring;

said inner surface having a groove disposed to be disengaged by the upper edge of said cylindrical skirt to open said groove into said chamber when said piston is held in rest position against the compression of said spring, and to be engaged by the upper edge of said cylindrical skirt to seal said groove against the admission of air into said chamber when said piston moves up against the compression of said coil spring;

a mixing chamber for air and product surrounding said spray dispensing nozzle;

means comprising a pressure-responsive flexible flange between said air chamber and said mixing chamber for admitting high pressure air into said mixing chamber; and a diaphragm disposed at the upper end of said tubular accumulator and responsive to the pressure of liquid product in said tubular accumulator to admit a quantity of said product into said mixing chamber, whereby said quantity of product is mixed in said mixing chamber with high pressure air and dispensed as dry spray through said spray-dispensing nozzle.

23. A combination in accordance with claim 1 wherein said means for maintaining said container at substantially ambient pressure comprises a small opening in said container closure;

a gasket of resilient material having outer and inner annuli connected by a hinge comprising a thin membrane of said material;

the outer one of said annuli being secured in place between the mouth of said container and the underside of said closure;

the inner one of said annuli normally sealed against the underside of said opening in response to pressure in said container at least equal to the ambient pressure, and deflecting to admit air when the pressure in said container falls below ambient pressure.

24. The combination in accordance with claim 23 wherein the inner periphery of said opening is slightly bulged in relation to the under surface of said closure for more readily sealing against said gasket.

25. A combination in accordance with claim 1 wherein said means for maintaining said container at substantially ambient pressure comprises a small opening in said container closure;

an annular gasket of resilient material, the outer edge of said gasket being secured in place between the mouth of said container and the underside of said closure; and the inner edge of said gasket terminating in a vertically extended flange of elliptical cross-section, whereby said flange normally seals against the underside of said closure in a manner to cut off the flow of air through said opening in response to pressure in said container at least equal to ambient pressure, and whereby said flange deflects to admit air when the pressure in said container falls below ambient pressure.

26. A combination in accordance with claim 1, which includes a cap placed over the accumulator housing, when the said spray dispenser is in the stored or shipping position;

and wherein said check-valve comprises means for preventing leakage of fluid from said dispenser in said stored or shipping position.

27. A combination in accordance with claim 26, wherein said means comprising said check-valve for preventing leakage of said fluid is constructed and arranged to seal against the upper wall of said accumulator housing and against the opening between said upper and lower end of said tubular piston, when the said trigger is depressed; and wherein said cap comprises means for holding said trigger depressed.

* * * * *

UNITED STATES PATENT AND TRADEMARK OFFICE

CERTIFICATE OF CORRECTION

PATENT NO. : 4,345,718

DATED : Aug. 24, 1982

INVENTOR(S) : William Horvath

It is certified that error appears in the above-identified patent and that said Letters Patent are hereby corrected as shown below:

Column 7, line 65 change "cpolymer" to ---copolymer---;
Column 9, line 19 change "btween" to ---between---;
Column 9, line 33 change "cuases" to ---causes---;

Column 23, line 2 change "alows" to ---allows---.

Signed and Sealed this

*Eighth* Day of *February 1983*

[SEAL]

*Attest:*

GERALD J. MOSSINGHOFF

*Attesting Officer* *Commissioner of Patents and Trademarks*